US009030272B2

(12) United States Patent
Nummerdor

(10) Patent No.: US 9,030,272 B2
(45) Date of Patent: May 12, 2015

(54) DUPLEX FILTER WITH RECESSED TOP PATTERN AND CAVITY

(71) Applicant: Jeffrey J. Nummerdor, Rio Rancho, NM (US)

(72) Inventor: Jeffrey J. Nummerdor, Rio Rancho, NM (US)

(73) Assignee: CTS Corporation, Elkhart, IN (US)

( * ) Notice: Subject to any disclaimer, the term of this patent is extended or adjusted under 35 U.S.C. 154(b) by 146 days.

(21) Appl. No.: 13/654,639

(22) Filed: Oct. 18, 2012

(65) Prior Publication Data

US 2013/0038404 A1 Feb. 14, 2013

Related U.S. Application Data

(63) Continuation-in-part of application No. 12/683,997, filed on Jan. 7, 2010, now Pat. No. 8,294,532, and a continuation-in-part of application No. 13/604,893, filed on Sep. 6, 2012.

(51) Int. Cl.
*H01P 1/213* (2006.01)
*H01P 1/205* (2006.01)

(52) U.S. Cl.
CPC ..... *H01P 1/2056* (2013.01); *H01P 1/2136* (2013.01)

(58) Field of Classification Search
CPC ... H01P 1/2056; H01P 1/2053; H01P 1/2136; H01P 1/2133
USPC ..... 333/202, 206, 134
See application file for complete search history.

(56) References Cited

U.S. PATENT DOCUMENTS

| | | | |
|---|---|---|---|
| 4,673,902 | A | 6/1987 | Takeda et al. |
| 4,737,746 | A | 4/1988 | Ueno |
| 4,757,288 | A | 7/1988 | West |
| 4,937,542 | A | 6/1990 | Nakatuka |
| 5,079,528 | A | 1/1992 | Yorita et al. |
| 5,144,269 | A | 9/1992 | Itoh |
| 5,157,365 | A | 10/1992 | Hoang |
| 5,177,458 | A | 1/1993 | Newell et al. |
| 5,191,305 | A | 3/1993 | Frost et al. |
| 5,208,566 | A | 5/1993 | Kenoun et al. |
| 5,214,398 | A | 5/1993 | Hayashi |
| 5,227,747 | A | 7/1993 | Komazaki et al. |
| 5,239,280 | A | 8/1993 | Noguchi et al. |
| 5,254,962 | A | 10/1993 | Morris et al. |
| 5,345,202 | A | 9/1994 | Kobayashi et al. |
| 5,486,799 | A | 1/1996 | Komazaki et al. |

(Continued)

FOREIGN PATENT DOCUMENTS

| | | |
|---|---|---|
| EP | 62 252202 | 11/1987 |
| EP | 0 364 931 | 4/1990 |

(Continued)

*Primary Examiner* — Benny Lee
(74) *Attorney, Agent, or Firm* — Daniel J. Deneufbourg

(57) ABSTRACT

A duplex filter includes a block of dielectric material with top, bottom, and side surfaces and first and second spaced-apart sets of through-holes. A pair of outside walls and a center wall extend outwardly from the top surface. A pattern of metallized areas is defined on the top surface of the block including first and second electrodes that extend on the pair of outside walls respectively and third and fourth electrode antennae that extend on the center wall. The block may be two separate blocks coupled together to form an interior layer of metallization separating the first and second sets of through-holes and the center wall separates respective transmit and receive portions of the pattern of metallized areas.

15 Claims, 8 Drawing Sheets

(56) References Cited

U.S. PATENT DOCUMENTS

| | | | | |
|---|---|---|---|---|
| 5,512,866 | A | 4/1996 | Vangala et al. | |
| 5,563,561 | A | 10/1996 | Ishihara et al. | |
| 5,572,175 | A | 11/1996 | Tada et al. | |
| 5,602,518 | A | 2/1997 | Clifford, Jr. et al. | |
| 5,686,873 | A | 11/1997 | Tada et al. | |
| 5,731,751 | A | 3/1998 | Vangala | |
| 5,783,978 | A | 7/1998 | Noguchi et al. | |
| 5,793,267 | A | 8/1998 | Tada et al. | |
| 5,896,073 | A | 4/1999 | Miyazaki et al. | |
| 5,959,511 | A | 9/1999 | Pasco et al. | |
| 6,023,207 | A | 2/2000 | Ito et al. | |
| 6,052,040 | A | 4/2000 | Hino | |
| 6,204,738 | B1 | 3/2001 | Toda et al. | |
| 6,236,288 | B1 | 5/2001 | Tsujiguchi | |
| 6,313,797 | B1 | 11/2001 | Kurita et al. | |
| 6,498,542 | B1 | 12/2002 | Kuroda et al. | |
| 6,570,473 | B2 | 5/2003 | Endo et al. | |
| 6,737,943 | B2 | 5/2004 | Takubo et al. | |
| 6,765,457 | B2 | 7/2004 | Tada et al. | |
| 8,294,532 | B2 * | 10/2012 | Nummerdor | 333/134 |
| 2001/0052832 | A1 | 12/2001 | Gotoh et al. | |
| 2002/0109562 | A1 | 8/2002 | Tsukamoto et al. | |
| 2002/0190818 | A1 | 12/2002 | Endou et al. | |
| 2003/0151468 | A1 | 8/2003 | Vangala et al. | |
| 2009/0146761 | A1 | 6/2009 | Nummerdor | |
| 2010/0029241 | A1 * | 2/2010 | Morga et al. | 455/339 |

FOREIGN PATENT DOCUMENTS

| | | |
|---|---|---|
| EP | 0 520 673 | 12/1992 |
| EP | 0 865 094 | 9/1998 |
| EP | 0 951 089 | 10/1999 |
| EP | 0 999 606 | 5/2000 |
| EP | 2005191983 | 7/2005 |
| GB | 2 210 225 | 6/1989 |
| JP | 61 004303 | 1/1986 |
| JP | 61 258502 | 11/1986 |
| JP | 62 252202 | 11/1987 |
| JP | 01 097002 | 4/1989 |
| JP | 2-101603 | 8/1990 |
| JP | 03 239001 | 10/1991 |
| JP | 404242301 | 8/1992 |
| JP | 405167308 | 7/1993 |
| JP | 405275905 | 10/1993 |
| JP | 406216607 | 8/1994 |
| JP | 2005 191983 | 7/2005 |
| WO | WO 95/30250 | 11/1995 |
| WO | WO 2009/075833 | 6/2009 |

* cited by examiner 10
14
60A
110A
112
112A
132
20
131
130
302
320
24
314
312
44
110B
112B
160
32
60B
114D
162
322
320
110C
25
60C
30
112C
60D
110
114F
164
114E
182
60E
110D
214
212
112D
114G
166
110E
112E
114H
140
183
150
142
60F
40
121
22
211
210
213
200
120
18
121
12
332
331
330
322
304
310
333
308
334
306
316
335
300
312
314
320
302
130
131
20
132
112A
112
110A
60A
14

DUPLEX FILTER WITH RECESSED TOP PATTERN AND CAVITY

CROSS-REFERENCE TO RELATED APPLICATIONS

This application is a continuation-in-part application of, and claims the benefit of the filing date and disclosure of, U.S. patent application Ser. No. 12/683,997 filed on Jan. 7, 2010, now U.S. Pat. No. 8,294,532 issued on Oct. 23, 2012, and U.S. patent application Ser. No. 13/604,893 filed on Sep. 6, 2012, the entire disclosures of which are explicitly incorporated herein by reference as are all references cited therein.

TECHNICAL FIELD

This invention relates to dielectric block filters for radio-frequency signals and, in particular, to monoblock duplex filters.

BACKGROUND OF THE INVENTION

Ceramic block filters offer several advantages over lumped component filters. The blocks are relatively easy to manufacture, rugged, and relatively compact. In the basic ceramic block filter design, the resonators are formed by typically cylindrical passages, called through-holes, extending through the block from the long narrow side to the opposite long narrow side. The block is substantially plated with a conductive material (i.e. metallized) on all but one of its six (outer) sides and on the inside walls formed by the resonator through-holes.

One of the two opposing sides containing through-hole openings is not fully metallized, but instead bears a metallization pattern designed to couple input and output signals through the series of resonators. This patterned side is conventionally labeled the top of the block. In some designs, the pattern may extend to sides of the block, where input/output electrodes are formed.

The reactive coupling between adjacent resonators is dictated, at least to some extent, by the physical dimensions of each resonator, by the orientation of each resonator with respect to the other resonators, and by aspects of the top surface metallization pattern. Interactions of the electromagnetic fields within and around the block are complex and difficult to predict.

These filters may also be equipped with an external metallic shield attached to and positioned across the open-circuited end of the block in order to cancel parasitic coupling between non-adjacent resonators and to achieve acceptable stopbands.

Although such RF signal filters have received widespread commercial acceptance since the 1980s, efforts at improvement on this basic design continued.

In the interest of allowing wireless communication providers to provide additional service, governments worldwide have allocated new higher RE frequencies for commercial use. To better exploit these newly allocated frequencies, standard setting organizations have adopted bandwidth specifications with compressed transmit and receive bands as well as individual channels. These trends are pushing the limits of duplex filter technology to provide sufficient frequency selectivity, increased band isolation, decreased insertion loss, decreased band interference, and reduced cross-talk.

Coupled with the higher frequencies and crowded channels are the customer trends towards the use of the same printed circuit board and filter across the different operating frequencies of different frequency platforms and the consumer market trends towards ever smaller wireless communication devices and longer battery life. Combined, these trends place difficult constraints on the design of wireless components such as filters. Filter designers may not simply add more space-taking resonators (i.e., increase the size of the filter) or allow greater insertion loss in order to provide improved signal rejection.

SUMMARY OF THE INVENTION

The present invention is generally directed to a filter which comprises a core with a top surface, a bottom surface, and side surfaces, the core defining a longitudinal axis, a first plurality of through-holes which extend longitudinally along the top surface of the core, a second plurality of through-holes which extend longitudinally along the top surface of the core in a spaced-apart and generally parallel relationship to the first plurality of through-holes, the first and second plurality of through-holes being spaced-apart from and located on opposite sides of the longitudinal axis of the core, each of the through-holes of the first and second plurality of through-holes extending through the core from an opening defined in the top surface of the core to an opening defined in the bottom surface of the core; a center wall which extends upwardly from the core in a relationship co-linear with the longitudinal axis of the core, the first and second plurality of through-holes being spaced-apart from and located on opposite sides of the center wall; and a surface-layer pattern of metallized and unmetallized areas on the core, the pattern including first and second connection areas of metallization located on the top surface, and a third connection area of metallization located on the top surface and extending on the center wall.

In one embodiment, the center wall defines a top rim adapted to be seated against a surface of a board.

In one embodiment, the filter further comprises first and second outside walls which extend upwardly from the top surface of the core, the center wall being located between and spaced from first and second outside walls and the first and second connection areas of metallization extending on the first and second outside walls respectively.

In one embodiment, the core is defined by first and second separate cores that have been coupled together in a side-by-side relationship and the center wall is defined by first walls on the first and second separate cores that have been coupled together in a side-by-side relationship.

In one embodiment, each of the first and second separate cores includes a side surface covered with a layer of metallization and the side surface of the first and second separate cores are coupled together to define a layer of metallization that extends through the interior of the core of the filter between the first and second plurality of through-holes.

In one embodiment, the filter further comprises an interior layer of metallization which extends through the core in a relationship co-linear with the center wall, the first and second plurality of through-holes being located on opposite sides of the layer of metallization.

The present invention is also directed to a filter that comprises a block with a top surface, a bottom surface, and at least one side surface, the block defining a first plurality of through-holes which extend between respective openings defined in the top and bottom surfaces, and a second plurality of through-holes which extend between respective openings defined in the top and bottom surfaces of the block and in a relationship spaced-apart from and generally parallel to the first plurality of through-holes; a plurality of walls which extend outwardly from the top surface of the block including first and second outside walls and a third wall extending between the first and second outside walls; a first pattern of metallized and unmetallized areas defined on the top surface of the block including an input connection area of metallization extending on the first wall and a first antenna connection area of metallization defined on the top surface and extending on the third wall; and a second pattern of metallized and unmetallized areas defined on the top surface of the block which includes an output connection area of metallization extending on the second wall and a second antenna connection area of metallization defined on the top surface and extending on the third wall and coupled to the first antenna connection area of metallization.

In one embodiment, the third wall extends longitudinally along the center of the block between and in a relationship spaced from and parallel to the first and second outside walls.

In one embodiment, the input and output connection areas of metallization are located at one end of the block and the first and second antenna connection areas of metallization are located at an opposite end of the block.

In one embodiment, the input and output connection areas of metallization are disposed in a co-linear and diametrically opposed relationship and the first and second antenna electrodes are disposed in a co-linear and diametrically opposed relationship.

In one embodiment, the block is comprised of first and second blocks that have been coupled together, the first and second patterns of metallized and unmetallized areas and the first and second outside walls being defined on the first and second blocks respectively.

In one embodiment, the third wall extends in a relationship generally co-linear with the longitudinal axis of the block and is defined by respective walls on the first and second blocks that have been joined together.

In one embodiment, the block is defined by first and second blocks that have been coupled together, each of the first and second blocks including a side surface covered with a layer of metallization and the side surface of the first and second blocks are coupled together to define a layer of metallization that extends through the interior of the block of the filter between the first and second plurality of through-holes.

The present invention is further directed to a filter that comprises a block with a top surface, a bottom surface, and at least one side surface, the block defining a first plurality of through-holes which extend between respective openings defined in the top and bottom surfaces, and a second plurality of through-holes which extend between respective openings defined in the top and bottom surfaces of the block and in a relationship spaced-apart from and generally parallel to the first plurality of through-holes; a plurality of walls which extend outwardly from the top surface of the block including at least a first wall, a second wall opposed to the first wall, and a third wall which extends outwardly from the top surface of the block, the third wall being located between and separating the respective openings of the first and second plurality of through-holes defined on the top surface of the block; a first pattern of metallized and unmetallized areas defined on the top surface of the block on one side of the third wall and including an input electrode defined on the top surface and extending on the first wall; and a second pattern of metallized and unmetallized areas defined on the top surface of the block on an opposite side of the third wall and including an output electrode defined on the top surface and extending on the second wall, and each of the first and second patterns of metallized and unmetallized areas including an antenna electrode defined on the top surface and both extending on the third wall.

In one embodiment, the block is defined by first and second separate blocks coupled together in a side-by-side relationship.

In one embodiment, each of the first and second separate blocks includes a side surface with a layer of metallization, the first and second separate blocks being coupled together along said side surface of said first and second separate blocks to define an interior layer of metallization in the block that separates the first and second plurality of through-holes.

There are other advantages and features of this invention, which will be more readily apparent from the following detailed description of one embodiment of the invention, the drawings, and the appended claims.

BRIEF DESCRIPTION OF THE FIGURES

In the accompanying drawings that form part of the specification, and in which like numerals are employed to designate like parts throughout the same.

DETAILED DESCRIPTION OF THE PREFFERED EMBODIMENTS

While this invention is susceptible to embodiment in many different forms, this specification and the accompanying drawings disclose one embodiment of the duplex filter in accordance with the present invention. The invention is, of course, not intended to be limited to the embodiment so described, however. The scope of the invention is identified in the appended claims.

Figure 2:
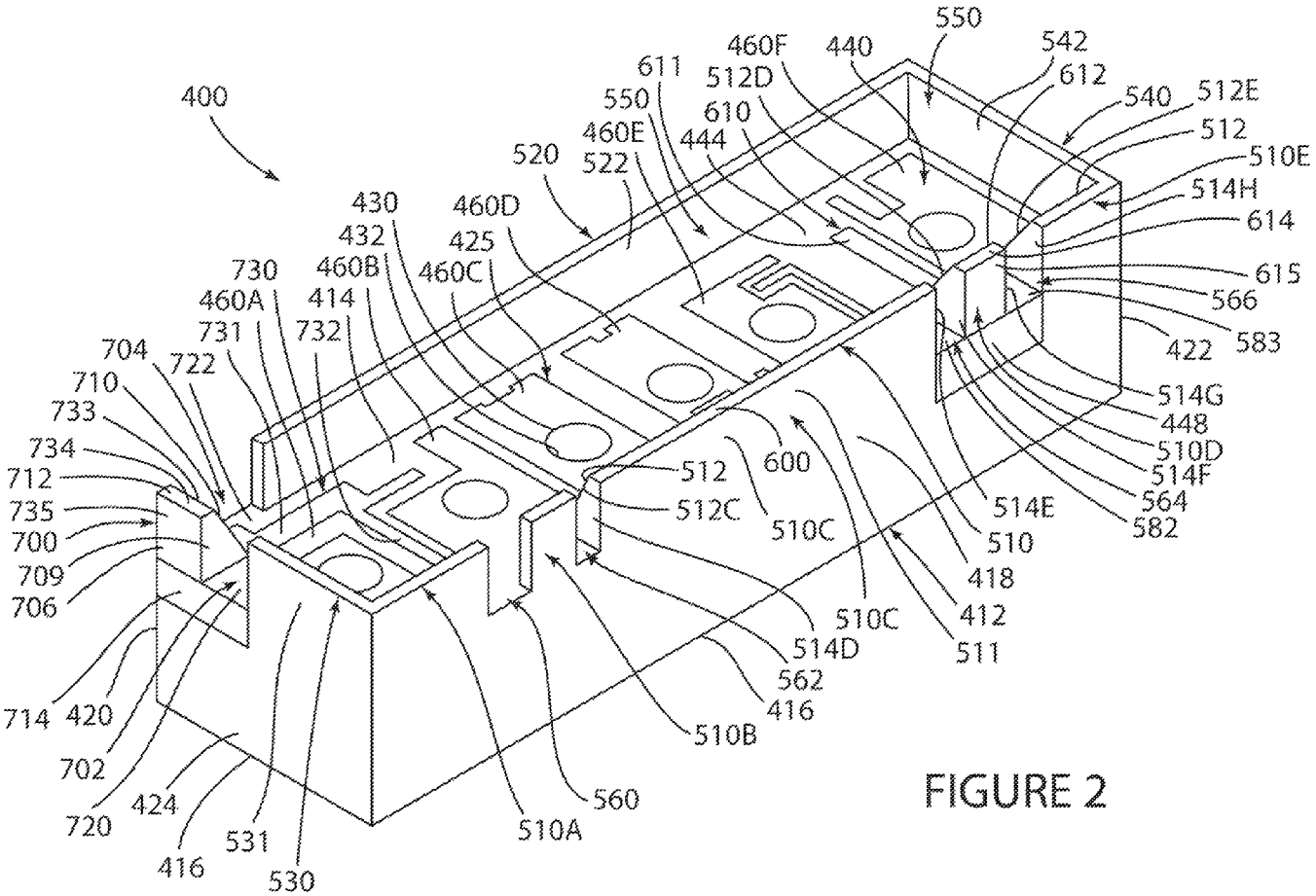
FIG. 2 is a top perspective view of the receive or high band filter or branch of the duplex filter of the present invention.
Figure 3:
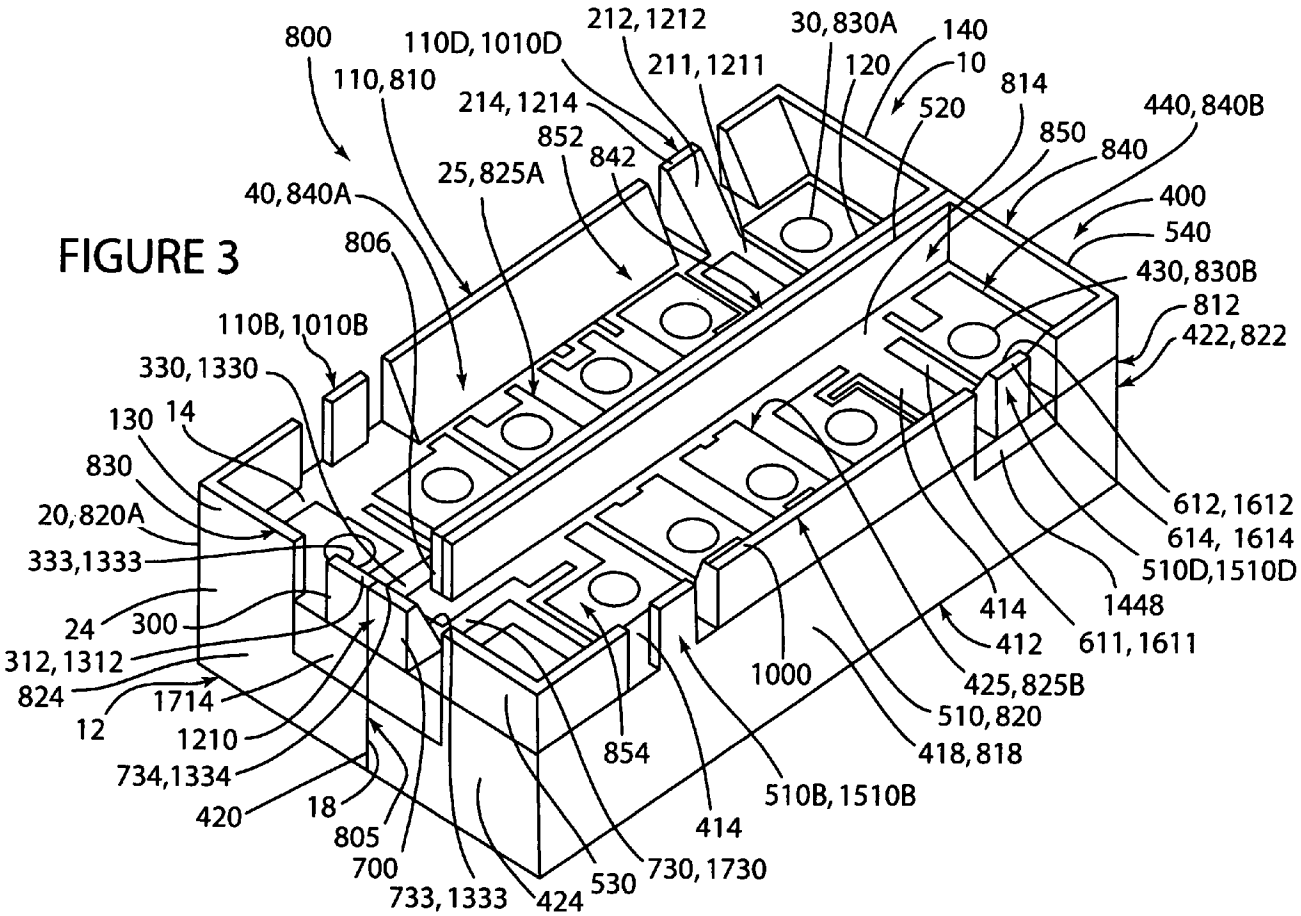
FIG. 3 is a top perspective view of one embodiment of the duplex filter in accordance with the present invention comprised of the FIG. 1 and FIG. 2 filters coupled together.

FIG. 3 depicts one embodiment of a duplex filter 800 in accordance with the present invention comprised of a transmit or low band simplex signal filter or branch 10 (FIG. 1) and a receive or high band simplex signal filter or branch 400 (FIG. 2) which have been appropriately coupled together in a side-by-side relationship as explained in more detail below.

Figure 1:
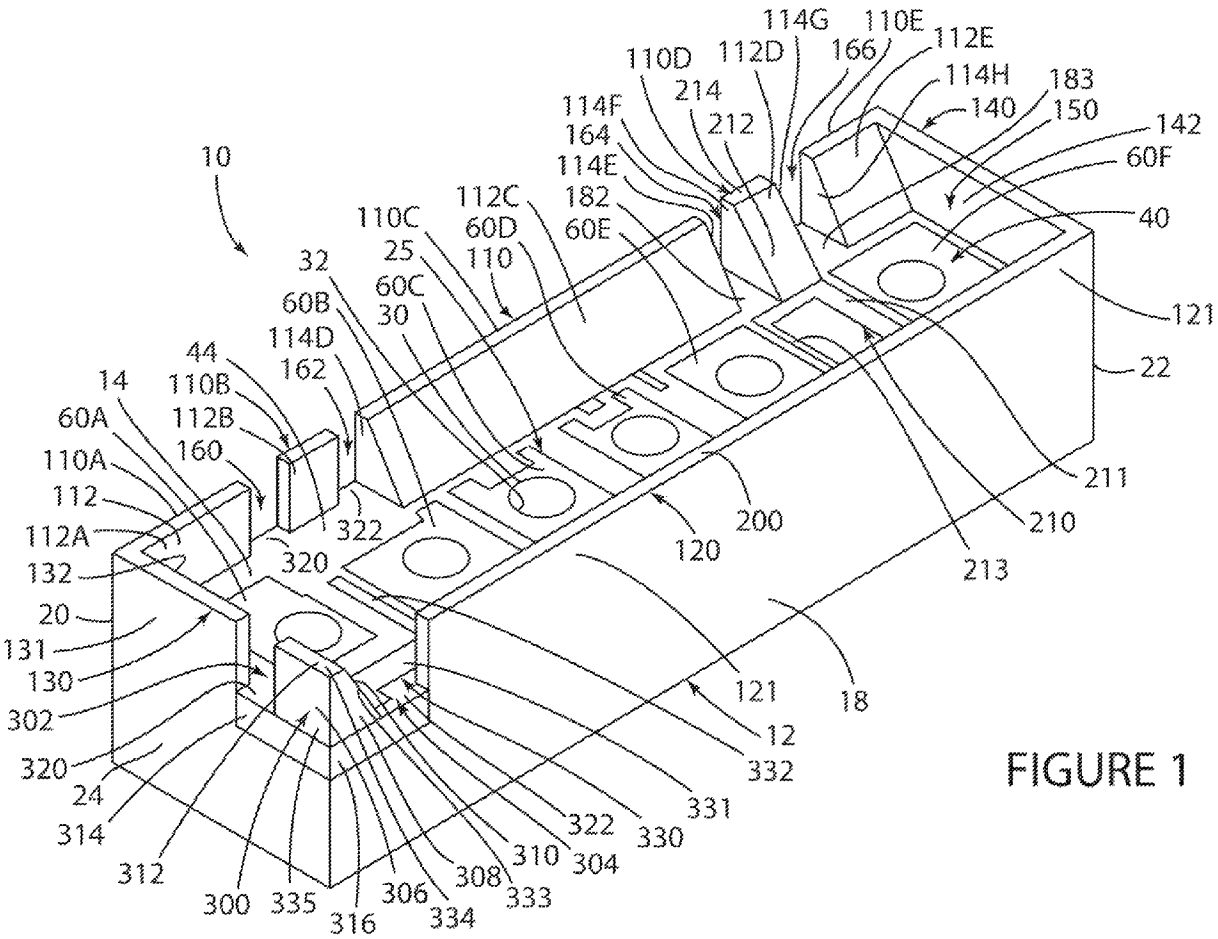
FIG. 1 is a top side perspective view of the transmit or low band filter or branch of the duplex filter of the present invention.

Referring to FIG. 1, transmit filter 10 of duplex filter 800 (FIG. 3) comprises a generally elongate, parallelepiped or box-shaped rigid block or core 12 comprised of a ceramic dielectric material having a desired dielectric constant. In one embodiment, the dielectric material can be a barium or neodymium ceramic with a dielectric constant of about 37 or above.

Core 12 defines an outer surface with six generally rectangular sides or surfaces: a top longitudinal surface 14; a bottom longitudinal surface 16 (FIG. 4) that is parallel to and diametrically opposed from top surface 14; a first side longitudinal surface 18; a second longitudinal side surface 20 (FIG. 4) that is parallel to and diametrically opposed from the first side longitudinal surface 18; a third transverse side or end surface 22; and a fourth transverse side or end surface 24 that is parallel to and diametrically opposed from the third transverse side or end surface 22.

Core 12 additionally defines four generally planar walls 110, 120, 130 and 140 that extend upwardly and outwardly away from the respective four outer peripheral edges of the top surface 14. Walls 110, 120, 130, 140 together define a peripheral top filter rim 200 and walls 110, 120, 130, 140 and top surface 14 together define a cavity 150 in the top of the filter 10.

Longitudinally extending walls 110 and 120 are parallel and diametrically opposed to each other. Transversely extending walls 130 and 140 are parallel and diametrically opposed to each other and are coupled to and generally normal with the walls 110 and 120.

Wall 110 has an outer surface 111 (FIG. 4) and an inner surface 112. The outer surface 111 is co-extensive and co-planar with side surface 20 (FIG. 4) A central portion 110C of wall 110 includes an inner surface 112C which slopes or angles outwardly and downwardly away from the rim 200 into top surface 14 in the direction of opposed wall 120 at approximately a 45 degree angle relative to both the top surface 14 and the wall 110. Walls 120, 130 and 140 all define generally vertical outer walls generally co-planar with the respective core side surfaces and generally vertical inner walls that are generally substantially in a relationship that is normal to the horizontal plane defined by top surface 14.

Wall 110 additionally defines a plurality of generally parallel and spaced-apart wall portions. An end wall portion 110A is defined adjacent and normal to the wall 130. An upwardly extending isolated ground wall portion or post or finger 110B is defined adjacent and spaced from the wall portion 110A. A slot 160 is defined between the end wall portion 110A and the post 110B. A central wall portion 110C is located adjacent but spaced from the post 110B. A slot 162 is defined between the post 110B and central wall portion 110C. An upwardly extending isolated wall portion or post or finger 110D is located adjacent but spaced from the central wall portion 110C. A slot 164 is defined between the central wall portion 110C and the post 110D. Post 110D is diametrically opposed to post 110B and is defined in an end portion of wall 110 adjacent the wall 140. An end wall portion 110E is defined between the wall 140 and the post 110D. Wall portion 110E is normal to the wall 140. A slot 166 is defined between the post 110D and the wall portion 110E.

Inner surface 112 of wall 110 is further separated into several portions including inner vertical portions 112A and 112B and inner angled or sloped surface portions 112C, 112D and 112E. Inner surface portion 112A is located on wall portion 110A. Inner surface portion 112B is located on wall portion or post 110B. Inner surface portion 112C is located on wall portion 110C. Inner surface portion 112D is located on wall portion or post 110B. Inner surface portion 112E is located on wall portion 110E.

Wall portions 110C, 110D, and 110E further define generally triangularly-shaped side walls. Specifically, wall portion 110C defines a side wall 114D spaced from post 110B and an opposed side wall 114E spaced from post 110D. Post 110D defines a side wall 114F spaced from wall portion 110C and a side wall 114G spaced from wall portion 110E. Wall portion 110E defines a side wall 114H spaced from post 110D.

Wall 120 has an outer surface 121 and an inner surface (not shown). Outer surface 121 is co-extensive and co-planar with the core side surface 18 and the inner surface (not shown) is normal with the core top surface 14.

Wall 130 has an outer surface 131 and an inner surface 132. Outer surface 131 is co-extensive and co-planar with the core side surface 24 and inner surface (not shown) is normal with the core top surface 14.

Wall 140 has an outer surface (not shown) and an inner surface 142. Outer surface (not shown) is co-extensive and co-planar with the core side surface 22 and inner surface 142 is normal with the core top surface 14.

An upwardly extending isolated wall portion or post or finger 300 is defined at a lower left corner of core 12 which bridges the core side surfaces 18 and 24. The post 300 is spaced from the walls 120 and 130 so as to define a slot 302 between the post 300 and wall 130 and a slot 304 between the post 300 and the wall 120. Post 300 defines a pair of generally triangularly-shaped side walls 308 which are not covered with metallization and are contiguous with the non-metallized area 44 as described in more detail below. The outside side wall 308 is co-planar with the side core surface 18 and the outside surface 121 of wall 120. Post 300 has a metallized top rim 312, a metallized front face 306 which is co-planar with the core end surface 24 and the outside surface 131 of wall 130, and a metallized inner angled or sloped surface 310.

Simplex transmit signal filter 10 additionally comprises a plurality of resonators 25 defined in part by a plurality of metallized through-holes 30 which are defined in dielectric core 12 and terminate in respective openings in the top and bottom surfaces 14 (FIG. 1) and 16 (FIG. 4) of the core 12. Through-holes 30 extend along the length of the block 12 from a point adjacent the core side surface 22 to a point adjacent the opposed core side surface 24 in a spaced-apart, co-linear relationship. Each of the through-holes 30 is defined by an inner cylindrical metallized side-wall surface 32.

Top surface 14 of core 12 additionally defines a surface-layer recessed pattern 40 of respective electrically conductive metallized and insulative unmetallized areas or patterns. A portion of pattern 40 is defined on the top surface 14 of core 12 and thus defines a recessed filter pattern by virtue of its recessed location at the base of cavity 150 in spaced relationship from and with the top rim 200 of core walls 110, 120, 130, and 140.

The metallized areas may be a surface layer of conductive silver-containing material. Recessed pattern 40 also defines a wide area or pattern of metallization that covers the core bottom surface 16, all of the core side surfaces, and the side wall 32 of respective through-holes 30 and extends contiguously from within resonator through-holes 30 towards both core top surface 14 and core bottom surface 16 and may also be labeled a ground electrode which serves to absorb or prevent transmission of off-band signals.

The recessed pattern 40 on core top surface 14 is at least comprised of resonator pads 60A, 60B, 60C, 60D, 60E and 60F which at least partially surround the top openings of respective through-holes 30. Resonator pads 60A-60 -F are contiguous or connected with the metallization area that extends through the respective inner surfaces 32 of through-holes 30 and are shaped to have predetermined capacitive couplings to adjacent resonators and other areas of surface-layer metallization.

An unmetallized area or pattern 44 surrounds all of the metallized resonator pads 60A-60F; extends over at least portions of the core side surface 18, 20, and 24; onto core top surface slot portions 182, 183, 320 and 322; and onto core side wall portions 114E, 114F, 114G, 114H, and outside side wall 308 of the post 300.

Unmetallized area 44 also defines a generally rectangularly-shaped unmetallized area 314 which extends onto a portion of core side surface 24 located below the front face 306 of the post 300 and the slot 302. Another generally rectangularly-shaped unmetallized area 316 is coupled with the area 314 and extends onto a portion of core side surface 18 located below the outside side wall 308 of post 300 and the slot 304.

A similar generally rectangularly-shaped unmetallized area 317 (FIG. 4) extends onto a portion of the core side surface 20 located above the post 110D and slots 164 and 166.

Surface-layer pattern 40 on core top surface 14 additionally defines a pair of isolated conductive metallized signal areas: a transmit input/output signal connection area or electrode 210; and an antenna input/output signal connection area or electrode 330.

Input/output signal connection area 210 extends onto a portion of wall 110 and, more specifically, onto the inner surface and top rim portions 112 and 200 of RF signal input/output post 110D to define, for example, a surface mounting transmit signal conductive connection point or pad or contact as described in more detail below.

Connection area of metallization or electrode 210 is located adjacent the wall 140. Input connection area or electrode 210 includes electrode portions 211, 212, 213 and 214. Electrode portion 211 is located between resonator pads 60E and 60F and connects with electrode portion 212 that is located on inner surface portion 112D of post 110D. Electrode portion 213 connects with electrode portions 211 and 212. Electrode portion 214 is located on the top rim portion 200 of post 110D. Electrode portion 214 connects with the electrode portion (not shown) that is located on the outer surface of the post 110D. Electrode portion 214 is surrounded on all sides by unmetallized areas.

Antenna connection area 330 extends onto post 300 where it serves as an antenna surface mounting conductive connection point or pad or contact or post as described in more detail below.

Antenna connection area of metallization or electrode 330 is generally L-shaped and located adjacent the wall 120. Electrode 330 includes electrode portions 331, 332, 333, 334 and 335. Electrode portion 332 is located between resonator pads 60A and 60B and connects with electrode portion 331. Electrode portion 333 is located on the inner surface portion 310 of post 300 and connects with electrode portion 331. Electrode portion 334 is located on the top rim portion 200 of post 300 and connects with electrode portion 333. Electrode portion 335 is located on the outer surface 306 of post 300 and is surrounded on all sides by unmetallized areas.

The recessed surface pattern 40 includes metallized areas and unmetallized areas. The metallized areas are spaced apart from one another and are therefore capacitively coupled. The amount of capacitive coupling is roughly related to the size of the metallization areas and the separation distance between adjacent metallized portions as well as the overall core configuration and the dielectric constant of the core dielectric material. Similarly, surface pattern 40 also creates inductive coupling between the metallized areas.

Turning now to FIG. 2, simplex receive signal filter 400 comprises a generally elongate, parallelepiped or box-shaped rigid block or core 412 comprised of a ceramic dielectric material having a desired dielectric constant. In one embodiment, the dielectric material can be a barium or neodymium ceramic with a dielectric constant of about 37 or above.

Core 412 defines an outer surface with six generally rectangular sides: a core top longitudinal surface 414; a core bottom longitudinal surface 416 (FIG. 4) that is parallel to and diametrically opposed from the core top surface 414; a first core side longitudinal surface 418; a second core side longitudinal surface 420 that is parallel to and diametrically opposed from side surface 418; a third transverse core side or end surface 424; and a fourth transverse core side or end surface 422 that is parallel to and diametrically opposed from the core end surface 424.

Core 412 additionally defines four generally planar walls 510, 520, 530 and 540 that extend upwardly and outwardly away from the respective four outer peripheral edges of the core top surface 414. Walls 510, 520, 530, and 540 together define a top peripheral rim 600 and the walls 510, 520, 530, 540 and top surface 414 together combine to define a cavity 550 at the top of the filter 400.

Longitudinally extending walls 510 and 520 are parallel and diametrically opposed to each other. Transversely extending walls 530 and 540 are parallel and diametrically opposed to each other and are coupled to, and generally normal to, the walls 510 and 520.

Wall 510 has an outer surface 511 and an inner surface 512. Outer surface 511 is co-extensive and co-planar with the core side surface 418 while a portion of the inner surface 512 slopes or angles outwardly and downwardly away from the rim 600 into the core top surface 414 in the direction of opposed wall 520 at approximately a 45 degree angle relative to both the core top surface 414 and the wall 510. Walls 520, 530 and 540 all define generally vertical outer walls generally co-planar with the respective core side surfaces 420, 424, and 422 and generally vertical inner walls that are generally substantially in a relationship that is normal to the horizontal plane defined by the core top surface 414.

Wall 510 additionally defines a plurality of generally parallel and spaced-apart slots 560, 562, 564 and 566.

An end wall portion 510A is defined between the wall 530 and slot 560. End wall portion 510A is normal to the wall 530. An isolated ground wall portion or post or finger 510B is located adjacent but spaced from the wall portion 510A and the space therebetween defines the slot 560. A center wall portion 510C is located adjacent but spaced from the post 510B and the space therebetween defines the slot 562. An isolated wall portion or post or finger 510D is located adjacent but, spaced from the center wall portion 510C and the space therebetween defines the slot 564. Post 510D is diametrically opposed to post 510B. An end wall portion 510E is located adjacent but spaced from the post 510B and the space therebetween defines the slot 566. Posts 510B and 510D extend generally normally outwardly and upwardly away from the core top surface 414 of filter 400.

The inner surface of selected ones of the portions of wall 510 is angled or sloped. An inner angled surface portion 512C is located on wall portion 510C. An inner angled surface portion 512D is located on wall portion or post 510D. An inner angled surface portion 512E is located on wall portion 510E.

Wall portions 510C, 510D, and 510E further define generally triangularly-shaped side walls. Specifically, wall portion 510C defines a side wall 514D adjacent the post 510B and an opposed side wall (not shown) adjacent the post 510D. Post 510D defines a side wall 514F adjacent the wall portion 510C and a side wall 514G adjacent the end wall portion 510E. Wall portion 510E defines a side wall 514H adjacent the post 510D.

Wall 520 has an outer surface (not shown) and an inner surface 522. The outer surface (not shown) is co-extensive and co-planar with the core side surface 420 and the inner surface 522 is normal with the core top surface 414.

Wall 530 has an outer surface 531 and an inner surface (not shown). Outer surface 531 is co-extensive and co-planar with the core side surface 424 and the inner surface (not shown) is normal with the core top surface 414.

Wall 540 has an outer surface (not shown) and an inner surface 542. The outer surface (not shown) is co-extensive and co-planar with the core side surface 422 and the inner surface 542 is normal with the core top surface 414.

An isolated wall portion or post or finger 700 is defined at the upper left corner of core 412 in a relationship adjacent and spaced from respective walls 520 and 530. The space between post 700 and wall 530 defines a slot 702. The space between the post 700 and the wall 520 defines a slot 704. Post 700 defines a pair of generally triangularly-shaped side walls 709 which are not covered with metallization and are contiguous with non-metallized area 444 on the core top surface 414 as described in more detail below. Post 700 has a metallized top rim 712, a metallized front face 706 which is co-planar with the core side surface 424 and the outer surface 531 of wall 530, and a metallized inner angled or sloped surface 710. Post 700 extends generally normally upwardly and outwardly from the top filter surface 414. The outside wall 709 of post 700 is co-planar with the core side surface 420 and the outer surface (not shown) of the wall 520.

Receive filter 400 has a plurality of resonators 425 defined in part by a plurality of through-holes 430 (FIGS. 3 and 4) which are defined in dielectric core 412. Through-holes 430 extend from and terminate in respective openings defined in the top and bottom core surfaces 414 and 416 respectively. Through-holes 430 extend along the longitudinal axis of block 412 in a spaced-apart and co-linear relationship. Each of through-holes 430 is defined by an inner cylindrical metallized side-wall surface 432.

Top surface 414 of core 412 additionally defines a surface-layer recessed pattern 440 of electrically conductive metallized and insulative unmetallized areas or patterns. A portion of pattern 440 is defined on the top surface 414 of core 412 and thus defines a recessed filter pattern by virtue of its recessed location at the base of cavity 550 in spaced relationship from and with the top rim 600 of walls 510, 520, 530, and 540.

The metallized areas may be a surface layer of conductive silver-containing material. Recessed pattern 440 also defines a wide area or pattern or portion of metallization that covers the top, bottom, and side core surfaces 414, 416, 418, 420, 422, and 424, and the inner walls 432 of through-holes 430 and extends contiguously from within resonator through-holes 430 towards both top surface 414 and bottom surface 416 and may also be labeled a ground electrode and serves to absorb or prevent transmission of off-band signals.

The recessed pattern 440 on the core top surface 414 comprises a plurality of resonator pads 460A, 460B, 460C, 460D, 460E and 460F which at least partially surround the respective openings of through-holes 430 defined on the core top surface 414. Resonator pads 460A-460F are contiguous or connected with the metallization area that extends through the respective inner surfaces 432 of through-holes 430 and are shaped to have predetermined capacitive couplings to adjacent resonators and other areas of surface-layer metallization.

An unmetallized area or pattern 444 extends over portions of the core top surface 414 and at least portions of the core side surfaces 418, 420, and 424. Unmetallized area 444 on the core top surface 414 surrounds all of the metallized resonator pads 460A-460F. Unmetallized area 444 also extends onto and covers at least top surface slot portions 582, 583, 720 and 722 and side wall portions 514E, 514F, 514G, 514H, and 709.

Unmetallized area 444 also defines a generally rectangularly-shaped unmetallized area 714 which extends onto a portion of core side surface 424 located below the front face 706 of post 700 and the slot 702. Another generally rectangularly-shaped unmetallized area (not shown) is coupled to the unmetallized area 714 and extends onto a portion of the core side surface 420 located below the outside side face (not shown) of the post 700 and the slot 704.

A similar generally rectangularly-shaped unmetallized area 448 extends onto a portion of the core side surface 418 located below the front face of the post 510D and the slots 564 and 566.

Surface-layer pattern 440 on the core top surface 414 additionally defines a pair of isolated conductive metallized connection areas including a receive signal input/output connection area or electrode 610 and an antenna input/output signal connection area or electrode 730.

Receive signal connection area 610 extends onto a portion of wall 510 and side surface 418 and, more specifically, onto the inner surface and nm portions 512D and 600 respectively of post 510D to define a surface mounting receive signal conductive connection point or pad or contact or post as described in more detail below.

Electrode 610 is located on top surface 414 adjacent wall 540. Connection area or electrode 610 includes electrode portions 611, 612, 614 and 615. Electrode portion 611 is located between resonator pads 460E and 460F and connects with electrode portion 612 that is located on the inner surface portion 512D of post 510D and connects with electrode portion 611. Electrode portion 614 is located on the rim 600 of post 510D and connects with electrode portion 612. Electrode portion 615 is located on the outside face of the post 510D and connects with electrode portion 614 and is surrounded on all sides by unmetallized areas.

Antenna connection area or electrode 730 extends onto the post 700 to define a surface mounting conductive antenna connection point or pad or contact or post as described in more detail below.

Antenna connection area of metallization or electrode 730 is generally L-shaped and is located on the core top surface 414 adjacent the wall 530. Connection area or electrode 730 includes electrode portions 731, 732, 733, 734 and 735. Electrode portion 732 is located between resonator pads 460A and 460B and connects with electrode portion 731. Electrode portion 733 is located on the inner surface portion 710 of post 700 and connects with electrode portion 731. Electrode portion 734 is located on the top rim portion 600 of post 700 and connects with electrode portion 733. Electrode portion 735 is located on the outer surface 706 of post 700 and connects with electrode portion 734. Electrode portion 735 is surrounded on all sides by unmetallized areas.

The recessed surface pattern 440 includes metallized areas and unmetallized areas. The metallized areas are spaced apart from one another and are therefore capacitively coupled. The amount of capacitive coupling is roughly related to the size of the metallization areas and the separation distance between adjacent metallized portions as well as the overall core configuration and the dielectric constant of the core dielectric material. Similarly, surface pattern 440 creates inductive coupling between the metallized areas.

With specific reference now to FIG. 3, low band or transmit signal simplex filter 10 is joined or coupled to high band or receive signal simplex filter 400 to form and define one embodiment of the duplex filter 800 in accordance with the present invention.

Filters 10 and 400 can be joined by a wide variety of methods. For example, because the outer faces of the side longitudinal core surfaces 18 and 420 of respective filters 10 and 400 are covered with metallization, filters 10 and 400 and, more specifically, the side surfaces 18 and 420 and respective walls 120 and 520 thereof may be placed in a side-by-side coupling and abutting relationship and then the filters 10 and 400 can be heated in a furnace causing the metallization on the outer face of side wall 18 of filter 10 and the metallization on the outer face of side wall 420 of filter 400 to sinter and fuse together to form a unitary center metallized interior filter wall 805 which forms and defines a ground plane extending longitudinally along and through the center of the duplex filter 800 between the respective first and second sets of through-holes 830A and 830B to advantageously electrically separate and isolate the same. Filters 10 and 400 may also be joined together using conductive epoxies, solders or mechanical joining techniques.

Figure 4:
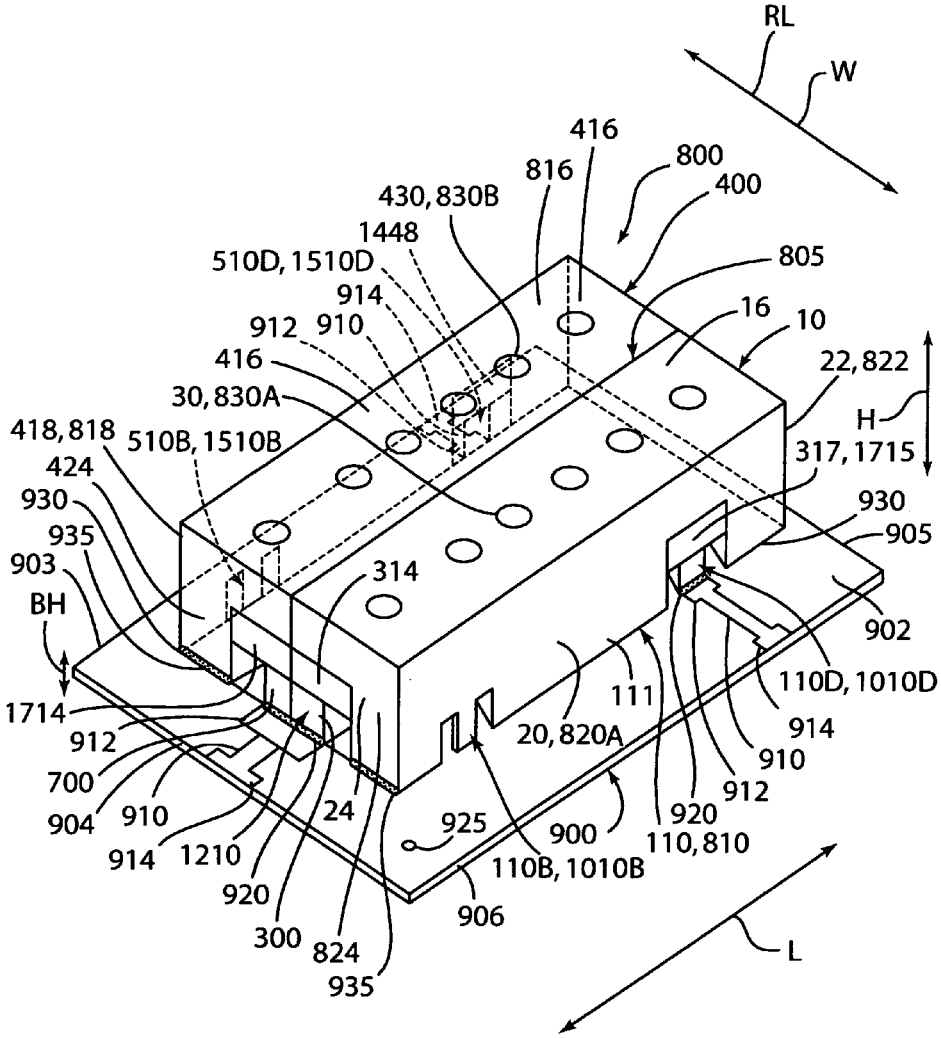
FIG. 4 is a top perspective view of the duplex filter of FIG. 3 mounted cavity/top side down to a customer's circuit board.

Duplex filter 800 being, in one embodiment, composed of the combination of the individual and separate simplex filters 10 and 400, thus comprises a generally elongate parallelepiped or box-shaped rigid block or core 812 defined by the cores 12 and 412 of respective filters 10 and 400. Core 812 defines an outer surface with six generally rectangular sides or surfaces: a top longitudinal surface 814 defined by the joined top longitudinal surfaces 14 and 414 of respective filters 10 and 400; a bottom longitudinal surface 816 (FIG. 4) which is defined by the joined bottom longitudinal surfaces 16 and 416 as shown in FIG. 4 of respective filters 10 and 400 and is parallel to and diametrically opposed from the core top surface 814; a first side longitudinal surface 818 defined by the side longitudinal surface 418 of filter 400; a second side longitudinal surface 820A (FIG. 4) defined by the side surface 20 of filter 10 and parallel to and diametrically opposed from the core side surface 818; a third side or end transverse surface 822 (FIGS. 3 and 4) defined by the joined side surfaces 22 and 422 of respective filters 10 and 400; and a fourth side or end transverse surface 824 which is defined by the joined side surfaces 24 and 424 of respective filters 10 and 400 and is parallel to and diametrically opposed from the end surface 822. The core surfaces 822 and 824 are normal with the core surfaces 818 and 820. The interior filter wall 805 is parallel to the core surfaces 818 and 820.

Core 812 additionally defines four generally planar walls that extend upwardly and outwardly away from the respective four outer peripheral edges of the top surface 814: longitudinal wall 810 which is defined by the wall 110 of filter 10; longitudinal wall 820 which is opposed to wall 810 and is defined by the wall 510 of filter 400; transverse side wall 830 which is defined by the joined walls 130 and 530 of respective filters 10 and 400; and transverse side wall 840 which is opposed to the wall 830 and is defined by the joined walls 140 and 540 of respective filters 10 and 400.

Walls 810, 820, 830, and 840 together define a top circumferential rim 1000; and walls 810, 820, 830, and 840 and the core top surface 814 together define a top filter cavity 850. Walls 810 and 820 are parallel and diametrically opposed to each other. Walls 830 and 840 are parallel and diametrically opposed to each other and are coupled to and generally normal to the walls 810 and 820.

Longitudinal wall 810 defines a pair of spaced-apart, isolated posts or fingers 1010B and 1010D defined by and corresponding in location, structure, and function to the posts or fingers 110B and 110D respectively of filter 10, the description of which is incorporated herein by reference. Post 1010B is located adjacent wall 830 while post 1010D is located adjacent opposed wall 840.

Opposed longitudinal wall 820 defines a pair of spaced-apart, isolated posts or fingers 1510B and 1510D defined by and corresponding in location, structure, and function to the posts or fingers 510B and 510D respectively of filter 400, the description of which is incorporated herein by reference. Post 1510B is located adjacent transverse wall 830 and is diametrically opposed to the post 1010B. Post 1510D is located adjacent transverse wall 840 and is diametrically opposed to post 1010D.

Transverse side wall 830 defines an isolated generally centrally located post or finger 1210 which is defined by the coupling together of posts or fingers 300 and 700 of filters 10 and 400 respectively and, more specifically, by the coupling together of the respective outside faces thereof into an abutting relationship.

Filter 800 further comprises a central interior longitudinal wall 842 which is defined by the joined walls 120 and 520 of respective filters 10 and 400 and extends in a longitudinal direction through the center of filter 800 from the wall 840 and terminates in an end wall 806 spaced from the opposite wall 830. Wall 842 extends upwardly and outwardly away from the core top surface 814 of filter 800 in a relationship parallel to and spaced from the walls 810 and 820. Wall 842 splits, divides, and isolates the filter top surface 814 and cavity 850 into respective generally rectangularly-shaped upper and lower, generally parallel and adjoining transmit and receive filter sections or cavities 852 and 854 respectively.

Cavity or section 852 is defined between the respective filter walls 810 and 842 while cavity or section 854 is defined between the respective filter walls 820 and 842.

Section 852 includes a plurality of resonators 825A defined in part by a plurality of resonator through-holes 830A and a pattern 840A of electrically conductive metallized and insulative unmetallized areas or patterns on the core top surface 814 defined by and corresponding in location, structure, and function to the resonators 25, through-holes 30, and pattern 40 respectively of filter 10, the description of which is thus incorporated herein by reference.

Through-holes 830A extend longitudinally along the core top surface 814 of the block/core 812 in spaced-apart and parallel relationship above and parallel to the central interior wall 842. Each of the through-holes 830A extends through the core 812 and terminates in respective openings defined in the respective top and bottom surfaces 814 and 816 of the core 812.

The pattern 840A, post 1010D, and post 1210 of filter 800 includes respective strips of conductive material 1211, 1212, 1214, 1330, 1333, and 1312 defined by and corresponding in location, structure, and function to the respective strips of conductive material 211, 212, 214, 330, 333, and 312 of pattern 40, post 110D, and post 300 of filter 10, the description of which is thus incorporated herein by reference.

Section 854 includes a plurality of resonators 825B defined in part by a plurality of resonator through-holes 830B which are diametrically opposed and parallel to resonator through-holes 830A and a pattern 840B of electrically conductive metallized and insulative unmetallized areas or patterns on the top surface 814 defined by and corresponding in location, structure, and function to the resonators 425, through-holes 430, and pattern 440 respectively of filter 400, the description of which is incorporated herein by reference.

Through-holes 830B extend longitudinally along the block/core 812 in a spaced-apart and parallel relationship below and parallel to central interior wall 842 and the through-holes 830A. Each of the through-holes 830B extend through the core 812 and terminate in respective openings defined in the respective top and bottom surfaces 814 and 816 of core 812.

The pattern 840B, post 1510D, and post 1210 of filter 800 include respective strips 1611, 1612, 1614, 1730, 1333, and 1334 of conductive material defined by and corresponding in location, structure, and function to the respective strips of conductive material 611, 612, 614, 730, 733, and 734 of pattern 440, post 510D, and post 700 respectively of filter 400, the description of which is thus incorporated herein by reference.

The patterns 840A and 840B additionally include a layer of metallization which covers the exterior filter surfaces 818, 820, 822, and 824; the exterior, interior, and rim of each of the walls 810, 820, 830, 840, and 842; and the interior of each of the resonator through-holes 830A and 830B with the exception of the unmetallized regions or areas 1448, 1714, and 1715 on the respective core side surfaces 818, 824, and 820. The unmetallized regions 1448, 1714, and 1715 (as shown in FIG. 4) are located below the posts 1510D, 1210, and 1010D respectively.

Thus, in the embodiment of FIG. 3, the transmit signal connection finger/post/pad/electrode 1010D is located on the longitudinal wall 810 of filter 800; the receive signal connection finger/post/pad/electrode 1510D is located on the opposite longitudinal wall 820 of filter 800 in a relationship diametrically opposed to the pad 1010D; and antenna connection finger/post/pad/electrode 1210 is located on the transverse wall 830 which couples the walls 810 and 820.

Additionally, it is understood that the central interior wall 842 isolates and separates the respective transmit and receive filter sections 852 and 854, the respective top surface metallization patterns 840A and 840B, and further that the respective through-holes 825A and 825B.

Turning now to FIG. 4, duplex filter 800 is shown therein mounted to a generally planar rectangular-shaped circuit board (PCB) 900. In one embodiment, circuit board 900 is a printed circuit board having a top surface 902, a bottom surface (not shown), and a plurality of side surfaces 903, 904, 905, and 906. Circuit board 900 has a board height BH that is measured along side 906 between the PCB top surface 902 and the bottom surface (not shown). Circuit board 900 additionally includes plated through-holes 925 that form an electrical connection between the PCB top and bottom surfaces. Several circuit lines 910 and connection pads 912 can be located on top surface 902 and connected with terminals 914. Circuit lines 910, connection pads 912, and terminals 914 are formed from a metal such as copper. Terminals 914 connect duplex filter 800 to an external electrical circuit (not shown).

Duplex filter 800 is mounted to the PCB 900 in a top side down relationship wherein the core top surface 814 is located opposite, parallel to, and spaced from the top surface 902 of PCB 900 and the rim 1000 (as shown in FIG. 3) of the walls 810, 820, 830, 840, and 842 of filter 800 is seated on and soldered to the top surface 902 of PCB 900. In this relationship, the cavity 850 defined by the filter 800 is partially sealed to define an enclosure defined by the top surface 814, the board surface 902, and the walls 810, 820, 830, 840, and 842.

It is further noted that, in this relationship, the generally vertical elongated through-holes 830A and 830B in duplex filter 800 are defined and oriented in a relationship generally substantially perpendicular to the PCB 900 wherein the openings of the respective through-holes 830A and 830B face, and are spaced from, the board top surface 902.

In the coupled relationship of FIG. 4, the antenna connection post or pad or electrode 1210 and, more specifically, the metallized rim portions 1312 and 1334 thereof on the rim 1000 (as shown in FIG. 3) are seated on and coupled to one of the metallized connection pads 912 of PCB 900 by solder 920. Similarly, transmit signal post or pad 1010D and, more specifically, the metallized rim portion 1214 is seated on and coupled to another one of the connection pads 912 on the board 900 by solder 920. Moreover, receive signal post or pad 1510D and, more specifically, the metallized rim portion 1614 thereof (as shown in FIG. 3) is likewise seated on and coupled to yet another connection pad 912 on the board top surface 902. The connection pads 912 in turn are coupled to the respective circuit lines 910.

It is noted that the location of the transmission/input and receive/output connection pads 1010D and 1510D on opposite longitudinal sides of the filter 800 advantageously reduces interference and cross-talk and further allows the respective transmission/input and receive/output circuit lines 910 to also be located on opposite longitudinal sides 903 and 906 of the board 900 to create better isolation and reduce interference between the respective circuit lines.

Circuit board 900 also has a generally rectangular-shaped ground ring or line 930 disposed on the top surface 902 that can be formed from copper and on which the rim of the respective electrodes and filter walls are attached by solder 935 (only a portion of which is shown in FIG. 4). For example, solders 920 and 935 are first screened onto ground ring 930 and connection pads 912 respectively. Next, duplex filter 800 is placed on top surface 902 such that electrode portions 1010D and 1210 are aligned with connection pads 912. Circuit board 900 and duplex filter 800 are then placed in a reflow oven to melt and reflow solders 920 and 935.

The attachment of the rim 1000 (as shown in FIG. 3) of the respective walls 810, 820, 830, 840, and 842 to the ground ring 930 forms an electrical path for the grounding of the majority of the outer surface of duplex filter 800.

As shown in FIG. 4, duplex filter 800 has a length L, a width W, a height H and a resonator length RL that is equal to H. For higher frequency filters that typically operate above 1.0 GHz, the design of the duplex filter 800 may require that the resonator length (RL) be less than or shorter than the board height (BH). In prior art filters that are mounted with either the bottom surface seated flat on the board (top surface facing up) or with one of the side surfaces seated flat on the board (top surface facing sideways), and where the resonator length becomes shorter then the board height, the filter can become unstable at higher frequencies when attached to the circuit board. Additional electromagnetic fields can be created that interfere with and reduce the attenuation of the filter. These additional electromagnetic fields can also reduce the attenuation and sharpness of the attenuation at the filter poles also known as zero points.

The use of duplex filter 800 of the present invention with recessed top surface patterns 840A and 840B on surface 814 (as all shown in FIG. 3) facing and opposite the board 900 provides improved grounding and off band signal absorption; confines the electromagnetic fields within cavity 850 (as shown in FIG. 3); and prevents external electromagnetic fields outside of cavity 850 (as shown in FIG. 3) from causing noise and interference such that the attenuation and zero points of the filter are improved.

The present invention allows the same footprint (length L and width W) to be used across multiple frequency bands. Prior art filters typically require a size or footprint that would either need to increase or decrease depending upon the desired frequency to be filtered. Filter 800 can have the same overall footprint and still be used at various frequencies.

Another advantage of the present invention is that, during solder reflow, filter 800 tends to self align with the ground ring 930 on the PCB 900. Filter 800 exhibits improved self alignment because the surface tension of the liquid solder 935 during reflow is distributed equally around the rims between ground ring 930 and the rims providing self-centering of the core 812.

The use of a duplex filter 800 also eliminates the need for a separate external metal shield or other shielding as currently used to reduce spurious electromagnetic interference incurred, as the walls 810, 820, 830, 840, and 842 and board 900 provide the shielding. Shielding could still be added, if needed or desired, to filter 800 for a specific application.

The present invention also provides improved grounding and confines the electrical fields within cavity 850 to create a filter 800 which exhibits steeper attenuation. As a result of the use of an interior cavity wall 842, isolation is also improved between the metallization patterns and resonator pads in the respective transmit and receive sections of the filter 800, thus allowing better harmonic suppression over conventional filters.

This present invention also further allows for the placement of input, output and antenna electrodes along any edge or wall of the filter 800. Although not shown, in one embodiment, the antenna electrode can be placed on the same side wall as either the transmit/input or receive/output electrodes or pads of the filter. In prior art surface mount filters, all of the electrodes are required to be on the same surface plane of the dielectric block.

Recessed patterns 840A and 840B still further create a resonant circuit that includes a capacitance and an inductance in series connected to ground. The shape of patterns 840A and 840B determines the overall capacitance and inductance values. The capacitance and inductance values are designed to form a resonant circuit that suppresses the frequency response at frequencies outside the passband including various harmonic frequencies at integer intervals of the passband.

While the embodiment shown depicts cavity 850 as being formed adjacent top surface 814, it is noted that the cavity and corresponding walls defining the same may be formed on any one or more of any of the other surfaces of the filter 800.

In still other embodiments, cavity 850 may only cover a portion of a surface or side of core 812. For example, cavity 850 may only encompass ten (10%) percent of the area of top surface 814. In another embodiment, multiple cavities may be located or formed on the same side or surface of core 812 by respective additional wall(s).

The present invention still further advantageously allows a duplex filter 800 to be formed simply by coupling together respective standard and simplex filters, thus simplifying the manufacturing process and reducing cost.

A duplex filter 800 having a length L of 16.17 mm., a height H of 5.1 mm., and a width W of 9.04 mm. was evaluated by computer simulation using microwave office computer simulation software. Simulated filter performance parameters are listed in TABLE 1, below.

TABLE 1

| | |
|---|---|
| High Pass Band | 925-930 Megahertz (MHz) |
| Low Pass Band | 880-915 Megahertz (MHz) |
| Isolation | 35.7 dB at 918 MHz |

Figure 5:
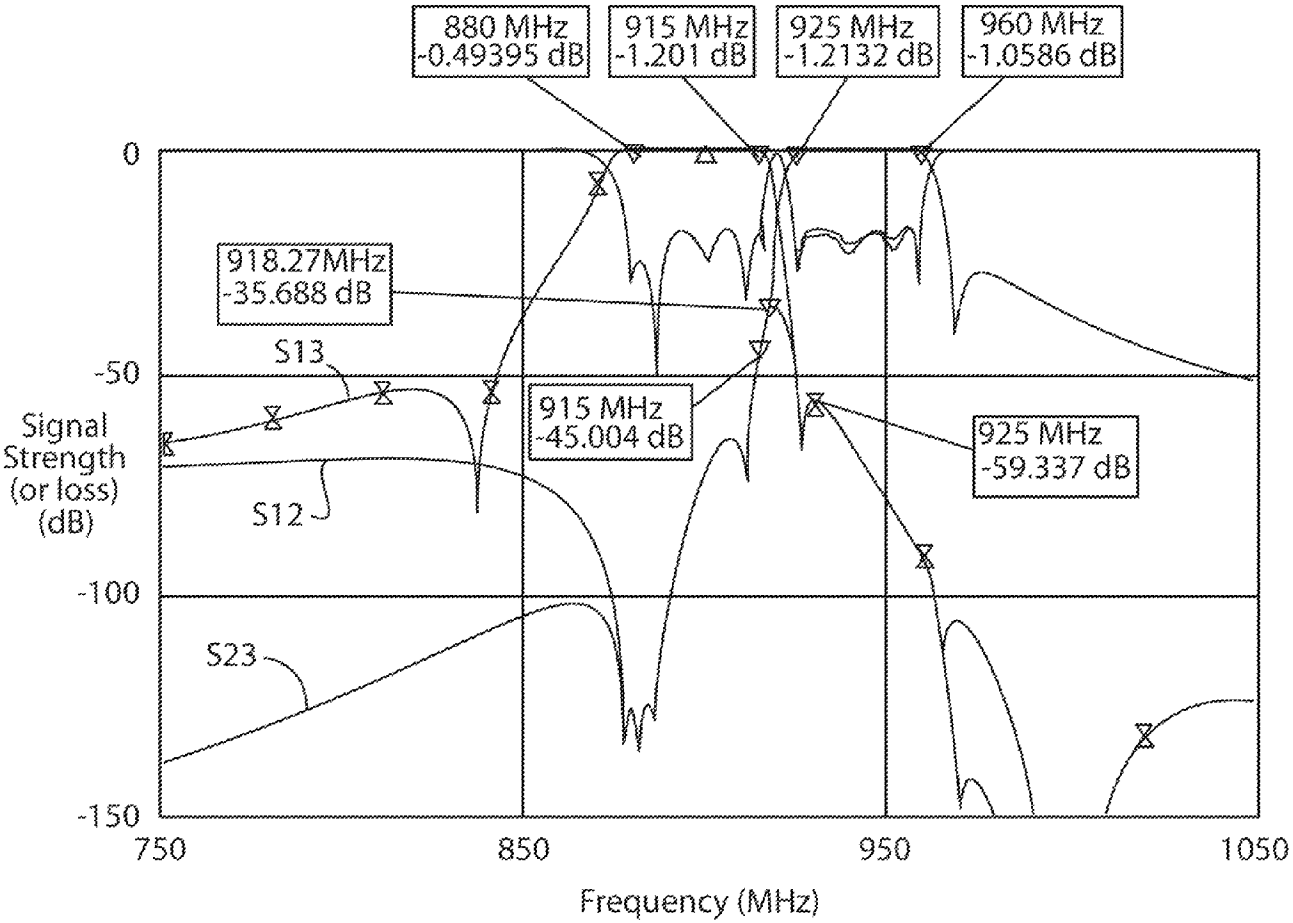
FIG. 5 is a graph of signal strength (or loss) versus frequency for the duplex filter of the present invention shown in FIGS. 3 and 4.

FIG. 5 is a graph of signal strength for loss) in dB versus frequency in MHz demonstrating the specific simulated performance of duplex filter 800 in accordance with the present invention which shows that: the low passband or transmit passband is between 880 and 915 MHz and between −0.49395 dB and −1.201 dB respectively; the high passband or receive passband is between 925 MHz and 960 MHz and between −1.2132 dB and −1.0586 dB respectively; duplex filter 800 has a peak isolation (S23) between the receive and transmit ports of −35.688 dB at 918.27 MHz which is an improvement over prior art duplex filters; duplex filter 800 has an S12 value of −45.004 dB at the end of the transmit passband at 915 MHz; and an S13 value of −59.337 dB at the end of the receive passband at 925 MHz.

The present invention can be applied to an RE signal filter operating at a variety of frequencies. Suitable applications include, but are not limited to, cellular telephones, cellular telephone base stations, and subscriber units. Other possible higher frequency applications include other telecommunication devices such as satellite communications, Global Positioning Satellites (GPS), or other microwave applications.

Figure 7:
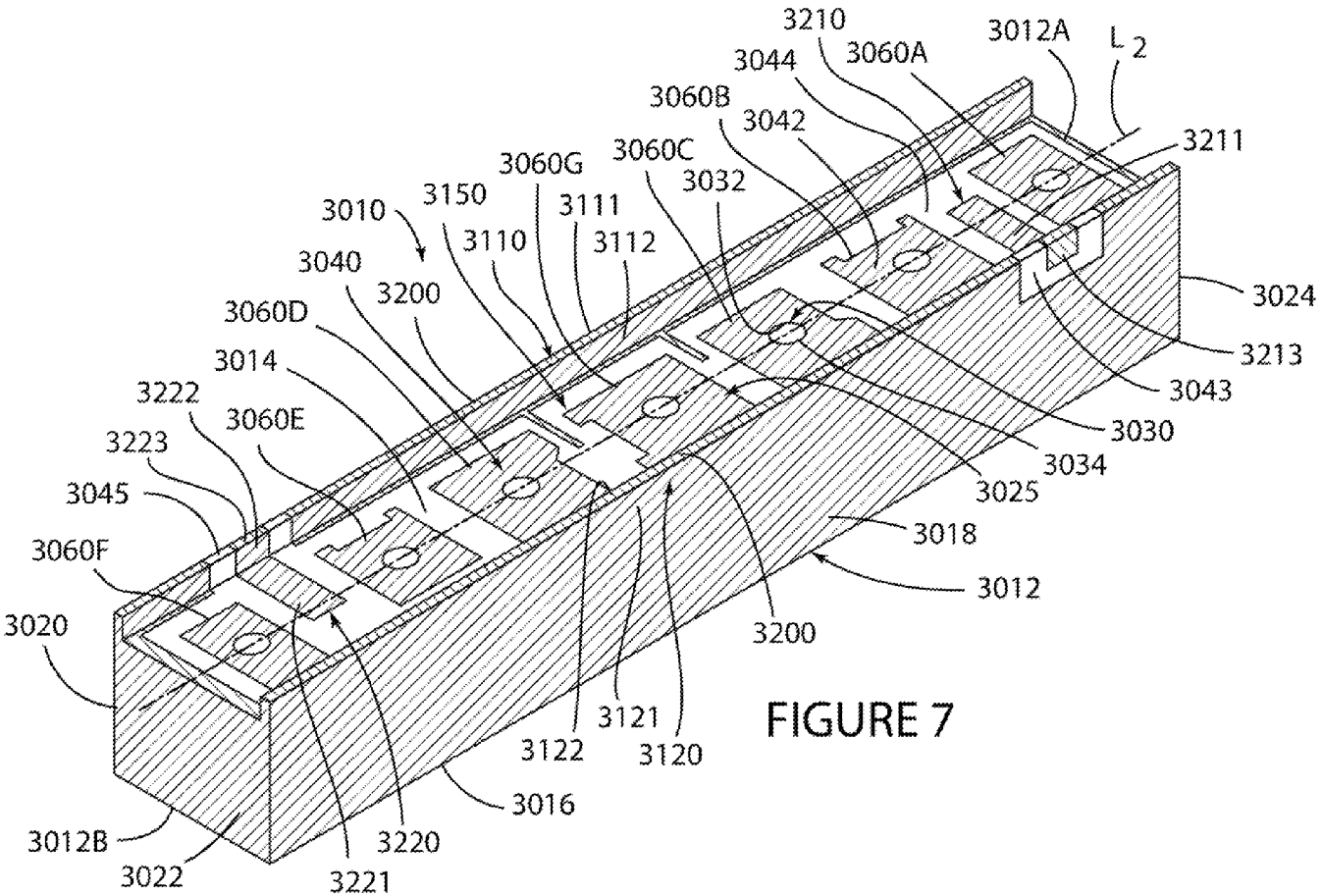
FIG. 7 is a top side perspective view of the receive or high band filter or branch of another embodiment of a duplex filter of the present invention.
Figure 8:
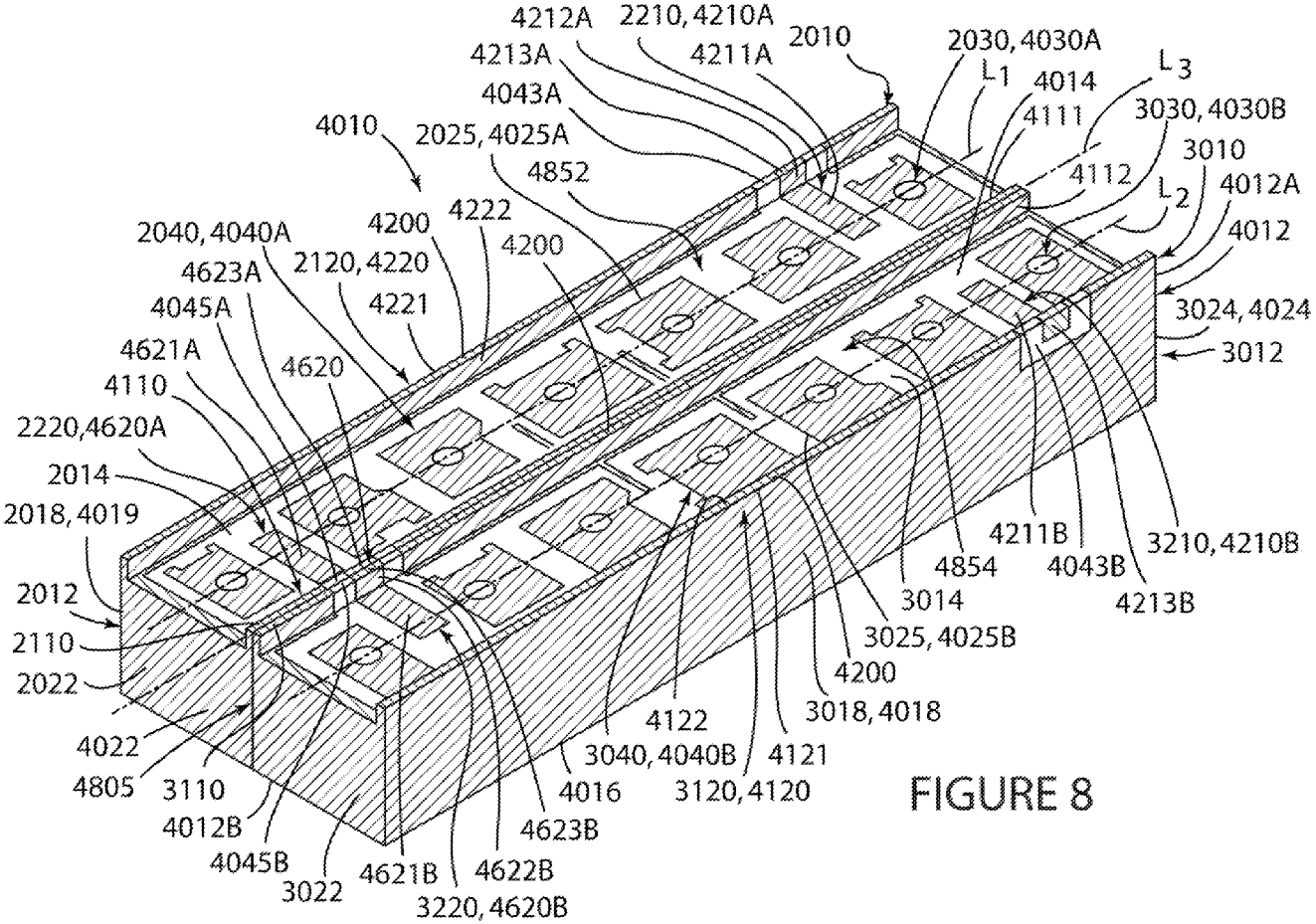
FIG. 8 is top side perspective view of another embodiment of a duplex filter of the present invention comprised of the FIG. 6 and FIG. 7 filters coupled together.

FIG. 8 depicts another embodiment of a duplex filter 4010 in accordance with the present invention comprised of a transmit or low band simplex signal filter or branch 2010 (FIG. 6) and a receive or high band simplex signal filter or branch 3010 (FIG. 7) which have been appropriately coupled together in a side-by-side relationship as described in more detail below.

Figure 6:
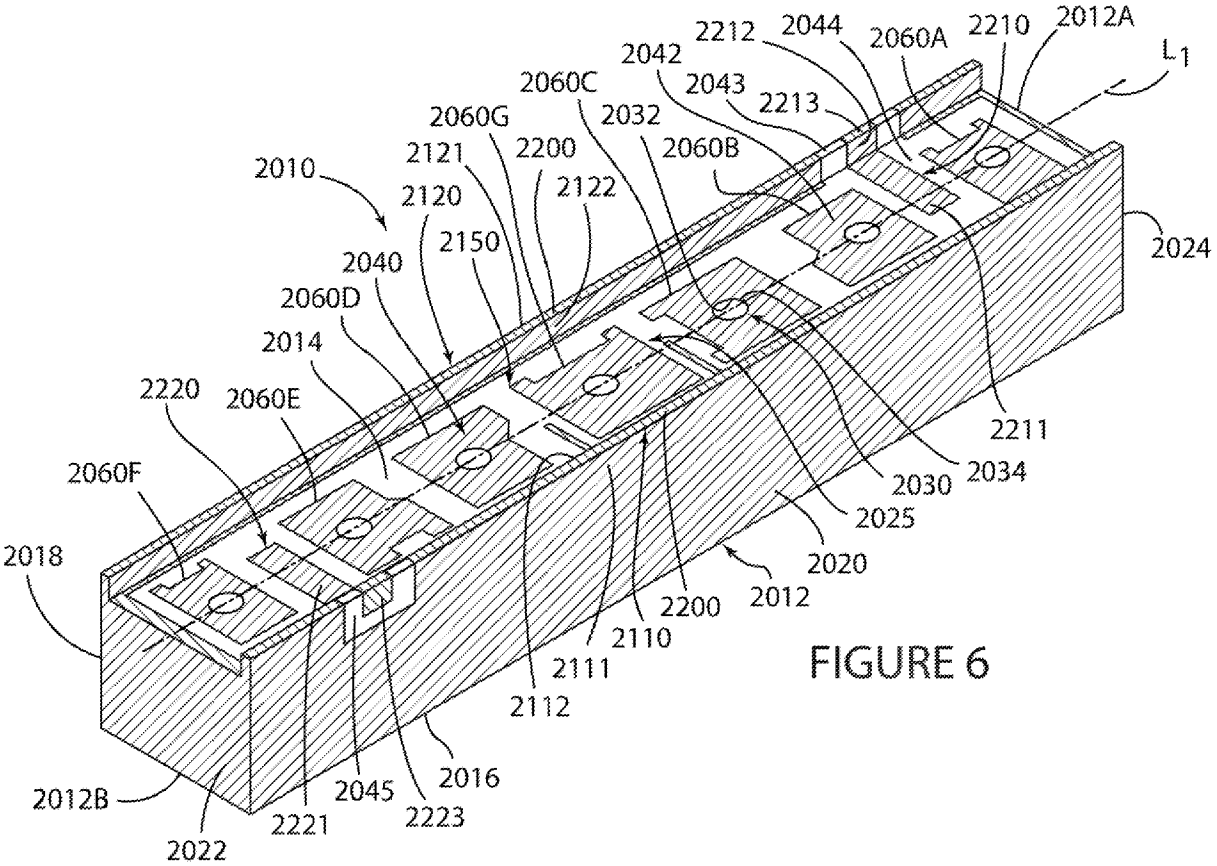
FIG. 6 is a top side perspective view of the transmit or low band filter or branch of another embodiment of a duplex filter of the present invention.

Referring to FIG. 6, transmit filter 2010 of duplex filter 4010 of FIG. 8 comprises a generally elongate, parallelepiped or box-shaped rigid block or core 2012 comprised of a ceramic dielectric material having a desired dielectric constant. In one embodiment, the dielectric material can be alumina, barium, or neodymium ceramic with a dielectric constant of about 12 or above.

Core 2012 defines a central longitudinal axis $L_1$ and includes opposed ends 2012A and 2012B. Core 2012 defines an outer surface with six generally rectangular sides: a top side or top longitudinally and horizontally extending surface 2014; a bottom side or bottom longitudinally and horizontally extending surface 2016 that is parallel to and diametrically opposed from top surface 2014; a first longitudinally and vertically extending side or side surface 2018 on a first side of, generally parallel to, and spaced from the core longitudinal axis $L_1$; a second longitudinally and vertically extending side or side surface 2020 that is parallel to and diametrically opposed and spaced from side surface 2018 and on a second opposite side of, generally parallel to, and spaced from the core longitudinal axis $L_1$; a third side or end surface 2022 that extends between, and in a relationship generally transverse to, the one ends of the top and bottom surfaces 2014 and 2016 respectively and the core longitudinal axis $L_1$; and a fourth side or end surface 2024 that is parallel to and diametrically opposed and spaced from end surface 2022 and extends between, and in a relationship generally transverse to, the other of the ends of the top and bottom surfaces 2014 and 2016 respectively and the core longitudinal axis $L_1$.

The core 2012 and the respective longitudinally extending side surfaces 2020 and 2018 additionally define a pair of generally planar, vertical, and elongated walls 2110 and 2120 respectively that protrude, project, and extend upwardly and outwardly away from the top surface 2014 of the core 2012 and, more specifically, upwardly and outwardly from the outer and upper longitudinally extending peripheral edge of the first and second side surfaces 2020 and 2018 of the core 2012. In the embodiment shown, the walls 2110 and 2120 is generally co-planar with the respective first and second side longitudinally extending surfaces 2020 and 2018 and extend longitudinally along and the length of the respective first and second longitudinally extending side surfaces 2020 and 2018 between the side surfaces 2022 and 2024.

Walls 2110 and 2120 are parallel and diametrically opposed to each other and extend on opposite sides of, and in a relationship generally parallel to and spaced from, the central longitudinal axis $L_1$ of the core 2012.

Wall 2110 has a generally vertical outer surface 2111, a generally vertical inner surface 2112, and a top peripheral and generally horizontal rim 2200. Outer surface 2111 is co-extensive and co-planar with side surface 2020. Inner surface 2112 is parallel to outer surface 2111 and normal to the top surface 2014.

Wall 2120 has a generally vertical outer surface 2121, a generally vertical inner surface 2122, and a top peripheral and generally horizontal rim 2200. Outer surface 2121 is co-extensive and co-planar with the side surface 2018 and the inner surface 2122 is generally parallel to the outer surface 2121 and normal to the top surface 2014.

The filter 2010 has a plurality of resonators 2025 defined in part by a plurality of metallized through-holes 2030 which are defined in dielectric core 2012. Through-holes 2030 extend from and terminate in openings 2034 in top surface 2014 and openings (not shown) in bottom surface 2016. Through-holes 2030 are aligned in a spaced-apart, co-linear relationship in the core 2012 such that through-holes 2030 extend in a relationship intersecting with and generally normal to the longitudinal axis $L_1$ of the core 2012. Each of the through-holes 2030 is defined by an inner cylindrical metallized side-wall surface 2032.

Top surface 2014 of core 2012 additionally defines a surface-layer recessed pattern 2040 of electrically conductive metallized and insulative unmetallized areas or patterns. Pattern 2040 is defined on the top surface 2014 of core 2012 and thus defines a recessed filter pattern by virtue of its recessed location at the base of cavity 2150 in spaced relationship from and with the top rim 2200 of the walls 2110 and 2120.

The metallized areas are preferably a surface layer of conductive silver-containing material. Recessed pattern 2040 also defines a wide area or pattern of metallization 2042 that covers bottom surface 2016 and the side surfaces 2018, 2022 and 2024. Wide area of metallization 2042 also covers a portion of top surface 2014 and side surface 2020 and side walls 2032 of through-holes 2030. Metallized area 2042 extends contiguously from within resonator through-holes 2030 towards both top surface 2014 and bottom surface 2016. Metallization area 2042 may also be labeled a ground electrode. Area 2042 serves to absorb or prevent transmission of off-band signals. A more detailed description of recessed pattern 2040 on top surface 2014 follows.

For example, a portion of metallized area 2042 is present in the form of surface-layer resonator pads 2060A, 2060B, 2060C, 2060D, 2060E, 2060F, and 2060G which surround respective through-hole openings 2034 defined on top surface 2014. Resonator pads 2060A, 2060B, 2060C, 2060D, 2060E, and 2060F are contiguous or connected with metallization area 2042 that extends through the respective inner surfaces 2032 of through-holes 2030. Resonator pads 2060A, 2060B, 2060C, 2060D, 2060E, and 2060F at least partially surround the respective openings 2034 of through-holes 2030. Resonator pads 2060A, 2060B, 2060C, 2060D, 2060E, 2060F, and 2060G are shaped to have predetermined capacitive couplings to adjacent resonators and other areas of surface-layer metallization.

An unmetallized area or pattern 2044 comprised of the dielectric material of the core 2012 extends over portions of top surface 2014 and portions of the side surface 2020. Unmetallized area 2044 surrounds all of the metallized resonator pads 2060A, 2060B, 2060C, 2060D, 2060E, 2060F, and 2060G.

Surface-layer pattern 2040 additionally defines a pair of isolated conductive metallized surface-layer areas for input/output/antenna connections to filter 2010. An input/output connection area of conductive material or electrode or elongate surface-layer strip of conductive material 2210 and an antenna connection area of conductive material or electrode or elongate surface-layer strip of conductive material 2220 are defined on top surface 2014 and extend onto the respective walls 2120 and 2110 and define respective surface mounting conductive connection points or pads or contacts as described in more detail below.

Electrode 2210 is located adjacent and parallel to filter side surface 2024 and normal to the wall 2120. Electrode 2220 is located adjacent and parallel to filter side surface 2022, normal to the wall 2110, and parallel to the electrode 2210.

Elongated input/output connection area of metallization or electrode or strip of conductive material 2210 is located adjacent the filter end 2012A and, in the embodiment shown, is in the form of a surface-layer continuous strip of conductive material that includes an electrode or strip portion 2211 that extends on the top surface 2014, an electrode or strip portion 2212 that extends on the inner surface 2122 of the wall 2120, and an electrode or strip portion 2213 that extends on and wraps around the top rim 2200 of the wall 2120, and extends onto and terminates on the exterior surface 2121 of the wall 2120.

The input/output connection area of metallization or electrode or strip of conductive material 2210 is isolated and separated from other regions or areas of metallized area 2042 by a surrounding region or area 2043 on the surface of the core 2012 including the top core surface 2014 and the wall 2120 comprised of dielectric material, i.e., a region or area of the core 2012 including the top core surface 2014 and the wall 2120 that surrounds the electrode 2210 and is devoid of conductive material.

Elongated antenna connection area of metallization or electrode or strip of conductive material 2220 is located adjacent the filter end 20128 and, in the embodiment shown, is in the form of an isolated surface-layer continuous strip of conductive material that includes an electrode or strip portion 2221 that extends on the top surface 2014, an electrode or strip portion (not shown but identical to the strip 2212 of input/output electrode 2210) that extends on the inner surface 2112 of the wall 2210, an electrode or strip portion 2223 that extends on and wraps around the top rim 2200 of the wall 2110 and extends onto and terminates on the exterior surface of the wall 2110.

The antenna connection area of metallization or electrode or strip of conductive material 2220 is isolated and separated from the other metallized areas 2042 by a surrounding region or area 2045 on the surface of the core 2012 comprised of dielectric material, i.e., a region or area of the core 2012 including the top core surface 2014 and the wall 2110 that surrounds the electrode 2220 and is devoid of conductive material.

Turning now to FIG. 7, simplex receive signal filter 3010 comprises a generally elongate, parallelepiped or box-shaped rigid block or core 3012 comprised of a ceramic dielectric material having a desired dielectric constant. In one embodiment, the dielectric material can be alumina, barium, or neodymium ceramic with a dielectric constant of about 12 or above.

Core 3012 defines a central longitudinal axis $L_2$ and includes opposed ends 3012A and 3012B. Core 3012 defines an outer surface with six generally rectangular sides: a top side or top longitudinally and horizontally extending surface 3014; a bottom side or bottom longitudinally and horizontally extending surface 3016 that is parallel to and diametrically opposed from top surface 3014; a first longitudinally and vertically extending side or side surface 3018 on a first side of, generally parallel to, and spaced from the core longitudinal axis $L_2$; a second longitudinally and vertically extending side or side surface 3020 that is parallel to and diametrically opposed and spaced from side surface 3018 and on a second opposite side of, generally parallel to, and spaced from the core longitudinal axis $L_2$; a third side or end surface 3022 that extends between, and in a relationship generally transverse to, the one ends of the top and bottom surfaces 3014 and 3016 respectively and the core longitudinal axis $L_2$; and a fourth side or end surface 3024 that is parallel to and diametrically opposed and spaced from end surface 3022 and extends between, and in a relationship generally transverse to, the other of the ends of the top and bottom surfaces 3014 and 3016 respectively and the core longitudinal axis $L_2$.

The core 3012 and the respective longitudinally extending side surfaces 3020 and 3018 additionally define a pair of generally planar, vertical, and elongated walls 3110 and 3120 that protrude, project, and extend upwardly and outwardly away from the top surface 3014 of the core 3012 and, more specifically, upwardly and outwardly from the outer and upper longitudinally extending peripheral edge of the first and second side surfaces 3020 and 3018 of the core 3012. In the embodiment shown, the walls 3110 and 3120 are generally co-planar with the respective first and second side longitudinally extending surfaces 3020 and 3018 and extend longitudinally along and the length of the respective first and second longitudinally extending side surfaces 3020 and 3018 between the side surfaces 3022 and 3024.

Walls 3110 and 3120 are parallel and diametrically opposed to each other and extend on opposite sides of, and in a relationship generally parallel to and spaced from, the central longitudinal axis $L_2$ of the core 3012.

Wall 3110 has a generally vertical outer surface 3111, a generally vertical inner surface 3112, and a top peripheral and generally horizontal rim 3200. Outer surface 3111 is co-extensive and co-planar with side surface 3020. Inner surface 3112 is parallel to outer surface 3111 and normal to the top surface 3014.

Wall 3120 has a generally vertical outer surface 3121, a generally vertical inner surface 3122, and a top peripheral and generally horizontal rim 3200. Outer surface 3121 is co-extensive and co-planar with the side surface 3018 and the inner surface 3122 is generally parallel to the outer surface 3121 and normal to the top surface 3014.

The filter 3010 has a plurality of resonators 3025 defined in part by a plurality of metallized through-holes 3030 which are defined in dielectric core 3012. Through-holes 3030 extend from and terminate in openings 3034 in top surface 3014 and openings (not shown) in bottom surface 3016. Through-holes 3030 are aligned in a spaced-apart, co-linear relationship in the core 3012 such that through-holes 3030 extend in a relationship intersecting with and generally normal to the longitudinal axis $L_2$ of the core 3012. Each of through-holes 3030 is defined by an inner cylindrical metallized side-wall surface 3032.

Top surface 3014 of core 3012 additionally defines a surface-layer recessed pattern 3040 of electrically conductive metallized and insulative unmetallized areas or patterns. Pattern 3040 is defined on the top surface 3014 of core 3012 and thus defines a recessed filter pattern by virtue of its recessed location at the base of cavity 3150 in spaced relationship from and with the top rim 3200 of the walls 3110 and 3120.

The metallized areas are preferably a surface layer of conductive silver-containing material. Recessed pattern 3040 also defines a wide area or pattern of metallization 3042 that covers bottom surface 3016 and the side surfaces 3018, 3022 and 3024. Wide area of metallization 3042 also covers a portion of top surface 3014 and side surface 3020 and side walls 3032 of through-holes 3030. Metallized area 3042 extends contiguously from within resonator through-holes 3030 towards both top surface 3014 and bottom surface 3016. Metallization area 3042 may also be labeled a ground electrode. Area 3042 serves to absorb or prevent transmission of off-band signals. A more detailed description of recessed pattern 3040 on top surface 3014 follows.

For example, a portion of metallized area 3042 is present in the form of surface-layer resonator pads 3060A, 3060B, 3060C, 3060D, 3060E, 3060F, and 3060G which surround respective through-hole openings 3034 defined on top surface 3014. Resonator pads 3060A, 3060B, 3060C, 3060D, 3060E, and 3060F are contiguous or connected with metallization area 3042 that extends through the respective inner surfaces 3032 of through-holes 3030. Resonator pads 3060A, 3060B, 3060C, 3060D, 3060E, and 3060F at least partially surround the respective openings 3034 of through-holes 3030. Resonator pads 3060A, 3060B, 3060C, 3060D, 3060E, 3060F, and 3060G are shaped to have predetermined capacitive couplings to adjacent resonators and other areas of surface-layer metallization.

An unmetallized area or pattern 3044 comprised of the dielectric material of the core 3012 extends over portions of top surface 3014 and portions of the side surface 3020. Unmetallized area 3044 surrounds all of the metallized resonator pads 3060A, 3060B, 3060C, 3060D, 3060E, 3060F, and 3060G.

Surface-layer pattern 3040 additionally defines a pair of isolated conductive metallized areas for input/output/antenna connections to filter 3010. An input/output connection area of conductive material or electrode or elongate surface-layer strip of conductive material 3210 and an antenna connection area of conductive material or electrode or elongate surface-layer strip of conductive material 3220 are defined on top surface 2014 and extend onto the respective walls 3120 and 3110 and define respective surface mounting conductive connection points or pads or contacts as described in more detail below.

Electrode 3210 is located adjacent and parallel to filter side surface 3024 and normal to the wall 3120. Electrode 3220 is located adjacent and parallel to filter side surface 3022, normal to the wall 3110, and parallel to the electrode 3210.

Elongated input/output connection area of metallization or electrode or strip of conductive material 3210 is located adjacent the filter end 3012A and, in the embodiment shown, is in the form of a surface-layer continuous strip of conductive material that includes an electrode or strip portion 3211 that extends on the top surface 3014, an electrode or strip portion (not shown but identical to the strip 3222 of electrode 3220) that extends on the inner surface 3122 of the wall 3120, and an electrode or strip portion 3213 that extends on and wraps around the top rim 3200 of the wall 3120, and extends onto and terminates on the exterior surface 3121 of the wall 3120.

The input/output connection area of metallization or electrode or strip of conductive material 3210 is isolated and separated from other regions or areas of metallized area 3042 by a surrounding region or area 3043 on the surface of the core 3012 including the top core surface 3014 and the wall 3120 comprised of dielectric material, i.e., a region or area of the core 3012 including the top core surface 3014 and the wall 3120 that surrounds the electrode 3210 and is devoid of conductive material.

Elongated output connection area of metallization or electrode or strip of conductive material 3220 is located adjacent the filter end 3012B and, in the embodiment shown, is in the form of an isolated surface-layer continuous strip of conductive material that includes an electrode or strip portion 3221 that extends on the top surface 3014, an electrode or strip portion 3222 that extends on the inner surface 3112 of the wall 3110, an electrode or strip portion 3223 that extends on and wraps around the top rim 3200 of the wall 3110 and extends onto and terminates on the exterior surface 3111 of the wall 3110.

The antenna connection area of metallization or electrode or strip of conductive material 3220 is isolated and separated from the other metallized areas 3042 by a surrounding region or area 3045 on the surface of the core 3012 including the top core surface 3014 and the wall 3110 comprised of dielectric material, i.e., a region or area of the core 3012 including the top core surface 3014 and the wall 3110 surrounding the electrode 3220 which is devoid of conductive material.

With specific reference now to FIG. 8, low band or transmit signal simplex filter 2010 is joined or coupled to high band or receive signal simplex filter 3010 to form and define the embodiment of the duplex filter 4010 in accordance with the present invention.

Filters 2010 and 3010 can be joined by a wide variety of methods. For example, because the outer faces of the side longitudinal core surfaces 2020 and 3020 of respective filters 2010 and 3010 are covered with metallization, the filters 2010 and 3010 and, more specifically, the side surfaces 2020 and 3020 and respective walls 2110 and 3110 thereof may be placed in a side-by-side coupling and abutting relationship and then the filters 2010 and 3010 can be heated in a furnace causing the metallization on the outer face of the side wall 2020 of the filter 2010 and the metallization on the outer face of the side wall 3020 of the filter 3010 to sinter and fuse together to form a unitary center metallized interior filter wall or region or layer of metallization 4805 which forms and defines a ground plane extending longitudinally along and through the center of the duplex filter 4010 between the respective first and second sets of through-holes 4030A and 4030B which are located on opposite sides of the interior wall of metallization 4805 (i.e., with the first set of through-holes 4030A on a first side of, spaced from, and parallel to the interior metallization wall 4805 and the second set of through-holes 4030B on a second opposite side of, spaced from, and parallel to the interior metallization wall 4805) to advantageously electrically separate and isolate the same. Filters 2010 and 3010 may also be joined together using conductive epoxies, solders or mechanical joining techniques.

Duplex filter 4010 being, in the embodiment of FIG. 8, composed of the combination of the individual and separate simplex filters 2010 and 3010, thus comprises a generally elongate parallelepiped or box-shaped rigid block or core 4012 defined by the cores 2012 and 3012 of respective filters 2010 and 3010.

Core 4012 defines a central longitudinal axis L3 and includes opposed ends 4012A and 4012B and defines an outer surface with six generally rectangular sides or surfaces: a top side or top longitudinally and horizontally extending surface 4014 defined by the joined top longitudinal surfaces 2014 and 3014 of respective filters 2010 and 3010; a bottom side or bottom longitudinally and horizontally extending surface 4016 that is parallel to and diametrically opposed from the top surface 4014 and is defined by the joined bottom side or bottom longitudinally and horizontally extending surfaces 2016 (FIGS. 6) and 3016 (FIG. 7) of respective filters 2010 and 3010; a first longitudinally and vertically extending side or side surface 4018 on a first side of, generally parallel to, and spaced from the core longitudinal axis L3 and defined by the first longitudinally and vertically extending side or side surface 3018 of filter 3010; a second longitudinally and vertically extending side or side surface 4019 that is parallel to and diametrically opposed and spaced from the side surface 4018 and on a second opposite side of, generally parallel to, and spaced from the core longitudinal axis L3 and is defined by the side surface 2018 of the filter 2010; a third side or end surface 4022 that extends between, and in a relationship generally transverse to, the one ends of the top and bottom surfaces 4014 and 4016 and the core longitudinal axis L3 and is defined by the joined side surfaces 2022 and 3022 of respective filters 2010 and 3010; and a fourth side or end surface 4024 that is parallel to and diametrically opposed and spaced from the end surface 4022 and extends between, and in a relationship generally transverse to, the other of the ends of the top and bottom surfaces 4014 and 4016 and the core longitudinal axis L3 and further is defined by the joined side surfaces 2024 and 3024 of respective filters 2010 and 3010.

The core surfaces 4022 and 4024 are normal with the core surfaces 4018 and 4019. The interior wall of metallization 4805 is parallel to the core surfaces 4018 and 4019 and co-linear with the core longitudinal axis $L_3$.

The core 4012 and the respective longitudinally extending side surfaces 4018 and 4019 additionally define a pair of generally planar, vertical, and elongated outside walls 4120 and 4220 respectively that protrude, project, and extend upwardly and outwardly away from the top surface 4014 of the core 4012 and, more specifically, upwardly and outwardly from the outer and upper longitudinally extending peripheral edge of the first and second side surfaces 4018 and 4019 of the core 4012. In the embodiment shown, each of the walls 4120 and 4220 is generally co-planar with the respective first and second side longitudinally extending surfaces 4018 and 4019 and extends longitudinally along and the length of the respective first and second longitudinally extending side surfaces 4018 and 4019 between the side surfaces 4022 and 4024.

Walls 4120 and 4220 are parallel and diametrically opposed to each other and extend on opposite sides of, and in a relationship generally parallel to and spaced from, the central longitudinal axis $L_3$ of the core 4012.

The wall 4120, which is defined by the wall 3120 of the filter 3010, has a generally vertical outer surface 4121, a generally vertical inner surface 4122, and a top peripheral and generally horizontal rim 4200. Outer surface 4221 is co-extensive and co-planar with side surface 4018. Inner surface 4122 is parallel to outer surface 4121 and normal to the top surface 4014.

The wall 4220, which is defined by the wall 2120 of the filter 2010, has a generally vertical outer surface 4221, a generally vertical inner surface 4222, and a top peripheral and generally horizontal rim 4200. Outer surface 4222 is co-extensive and co-planar with the side surface 4019 and the inner surface 4122 is generally parallel to the outer surface 4221 and normal to the top surface 4014.

The filter 4010 further comprises a central interior or inside longitudinal wall 4110 that is located between the walls 4120 and 4220 and is defined by the joined walls 2110 and 3110 of respective filters 2010 and 3010; includes opposed vertical longitudinally extending exterior or outer opposed surfaces 4111 and 4112; a top horizontal longitudinally extending rim 4200; and extends in a longitudinal direction along the center of the filter 4010.

The center wall 4110 extends upwardly and outwardly away from the core top surface 4014 of filter 4010 in a relationship parallel to and spaced from the walls 4120 and 4220 and further in a relationship co-linear with the core longitudinal axis $L_3$. The center wall 4110 splits, divides, and isolates the filter top surface 4014 into respective generally rectangularly-shaped upper and lower, generally parallel and adjoining transmit and receive filter sections or cavities 4852 and 4854 respectively that are located on opposite sides of the outer wall 4110 and the core longitudinal axis $L_3$.

Cavity or section 4852 is defined and located between the outside wall 4220 and the center inside wall 4110 while cavity or section 4854 is defined and located between the side wall 4120 and the center wall 4110.

Section 4852 includes a plurality of resonators 4025A defined in part by a plurality of resonator through-holes 4030A and a recessed surface layer pattern 4040A of electrically conductive metallized and insulative unmetallized areas or patterns on the core top surface 4014 defined by and corresponding in location, structure, and function to the resonators 2025, through-holes 2030, and recessed surface layer pattern 2040 respectively of the filter 2010 the description of which is thus incorporated herein by reference.

Through-holes 4030A, which are co-linearly aligned with each other, extend longitudinally along the core top surface 4014 of the block/core 4012 in a spaced-apart and parallel relationship above, on a first side of, and parallel, to the central interior or inside wall 4110 and the core longitudinal axis $L_3$. Each of the through-holes 4030A extends through the core 4012 and terminates in respective openings defined in the respective top and bottom surfaces 4014 and 4016 of the core 4012.

Section 4854 includes a plurality of resonators 4025B defined in part by a plurality of resonator through-holes 4030B which are diametrically opposed and parallel to resonator through-holes 4030A and a recessed, surface layer pattern 4040B of electrically conductive metallized and insulative unmetallized areas or patterns on the top surface 4014 defined by and corresponding in location, structure, and function to the resonators 3025, through-holes 3030, and a second, surface layer pattern 3040 respectively of filter 3010, the description of which is incorporated herein by reference.

Through-holes 4030B, which are co-linearly aligned with each other, extend longitudinally along the block/core 4012 in a spaced-apart and parallel relationship below, on a second side of, and parallel to the central interior or inside wall 4110, the core longitudinal axis $L_3$, and the through-holes 4030A. Each of the through-holes 4030B extend through the core 4012 and terminate in respective openings defined in the respective top and bottom surfaces 4014 and 4016 of core 4012.

The patterns 4040A and 4040B additionally include a layer of metallization which covers the exterior filter surfaces 4018, 4019, 4022, and 4024; the exterior, interior, and rim of each of the walls 4110, 4120, and 4220; and the interior of each of the resonator through-holes 830A and 830B, with the exception of the unmetallized regions or areas as discussed in more detail below.

Surface-layer pattern 4040A of filter section 4852 additionally defines a pair of isolated conductive metallized areas for input/output/antenna connections to filter 4010. An input/output connection area of conductive material or electrode or elongate surface-layer strip of conductive material 4210A and an antenna connection area of conductive material or electrode or elongate surface-layer strip of conductive material 4620A are defined on top surface 4014 and extend onto the side wall 4220 and the center wall 4110 respectively and define respective surface mounting conductive connection points or pads or contacts as described in more detail below.

Electrode 4210A, which is defined by the electrode 2210 on filter 2010, is located adjacent and parallel to filter side surface 4024 and normal to the side wall 4220. Electrode 4220A is located adjacent and parallel to filter side surface 4022, normal to the central wall 4110, and parallel to the electrode 4210A.

Elongated input/output connection area of metallization or electrode or strip of conductive material 4210A is located adjacent the filter end 4012A and, in the embodiment shown, is in the form of a surface-layer continuous strip of conductive material that includes an electrode or strip portion 4211A that extends on the top surface 4014, an electrode or strip portion 4212A that extends on the inner surface 4222 of the outside wall 4220, and an electrode or strip portion 4213A that extends on and wraps around the top rim 4200 of the outside wall 4220, and extends onto and terminates on the exterior surface 4221 of the outside wall 4220.

The input/output connection area of metallization or electrode or strip of conductive material 4210A is isolated and separated from the metallized regions or areas of pattern 4040A by a surrounding region or area 4043A on the surface of the core 4012 including the core top surface 4014 and the outside wall 4220 comprised of dielectric material, i.e., a region or area of the core 4012 including the core top surface 4014 and the outside wall 4220 that surrounds the electrode 4210A and is devoid of conductive material.

Elongated antenna connection area of metallization or electrode or strip of conductive material 4620A, which is defined by the electrode 2220 of filter 2010, is located adjacent the filter end 4012B and, in the embodiment shown, is in the form of an isolated surface-layer continuous strip of conductive material that includes an electrode or strip portion 4621A that extends on the top surface 4014, an electrode or strip portion (not shown but identical to the strip 4623B of antenna electrode 4620B) that extends on the outer surface 4111 of the center inside wall 4110, and an electrode or strip portion 4623A that extends on the top rim 4200 of the center inside wall 4110.

The antenna connection area of metallization or electrode or strip of conductive material 4620A is isolated and separated from the other metallized areas of pattern 4040A by a surrounding region or area 4045A on the surface of the core 4012 including the core top surface 4014 and the center inside wall 4110 comprised of dielectric material, i.e., a region or area of the core 4012 including the core top surface 4014 and the inside wall 4110 surrounding the electrode 4620A which is devoid of conductive material.

Surface-layer pattern 4040B of filter section 4854 additionally defines a pair of isolated conductive metallized areas for input/output/antenna connections to filter 4010. An input/output connection area of conductive material or electrode or elongate surface-layer strip of conductive material 4210B and an antenna connection area of conductive material or electrode or elongate surface-layer strip of conductive material 4220B are defined on top surface 4014 and extend onto the outside wall 4120 and the center inside wall 4110 respectively and define respective surface mounting conductive connection points or pads or contacts as described in more detail below.

Electrode 4210B, which is defined by the electrode 3210 of filter 3010, is located adjacent and parallel to filter side surface 4024, normal to the wall 4120, and diametrically opposed to and co-linear with the electrode 4210A. Electrode 4220B is located adjacent and parallel to the filter side surface 4022, normal to the center wall 4110, parallel to the electrodes 4210A and 4210B, and diametrically opposed to, co-linear with, and coupled to the electrode 4220A.

Elongated input/output connection area of metallization or electrode or strip of conductive material 4210B is located adjacent the filter end 4012A and, in the embodiment shown, is in the form of a surface-layer continuous strip of conductive material that includes an electrode or strip portion 4211B that extends on the top surface 4014, an electrode or strip portion (not shown but identical to the strip 4212A of electrode 4210A) that extends on the inner surface 4122 of the wall 4120, and an electrode or strip portion 4213B that extends on and wraps around the top rim 4200 of the outside wall 4120, and extends onto and terminates on the exterior surface 4121 of the outside wall 4120.

The input/output connection area of metallization or electrode or strip of conductive material 4210B is isolated and separated from the other metallized regions or areas of the pattern 4040B by a surrounding region or area 4043B on the surface of the core 4012 including the core top surface 4014 and the outside wall 4120 comprised of dielectric material, i.e., a region or area of the core 4012 including the core top surface 4014 and the outside wall 4120 that surrounds the electrode 4210B and is devoid of conductive material.

Elongated antenna connection area of metallization or electrode or strip of conductive material 4620B, which is defined by the electrode 3220 of filter 3010, is located adjacent the filter end 4012B and, in the embodiment shown, is in the form of an isolated surface-layer continuous strip of conductive material that includes an electrode or strip portion 4621B that extends on the top surface 4014, an electrode or strip portion 4622B that extends on the outer surface 4112 of the center inside wall 4110, and an electrode or strip portion 4623B that extends on the top rim 4200 of the center inside wall 4110 and is coupled to the electrode or strip portion 4623A of electrode 4620A.

The antenna connection area of metallization or electrode or strip of conductive material 4620B is isolated and separated from the other metallized areas of the pattern 4040B by a surrounding region or area 4045B on the surface of the core 4012 including the core top surface 4014 and the center inside wall 4110 comprised of dielectric material, i.e., a region or area of the core 4012 including the core top surface 4014 and the center inside wall 4110 surrounding the electrode 4620B which is devoid of conductive material.

Thus, and as shown in FIG. 8, the duplex filter 4010 includes an elongated antenna connection area of metallization or electrode or strip of conductive material 4620 located at one end of the filter 4010 that includes a center strip or portion (defined by the respective strips of the electrodes 4620A and 4620B defined on the top rim 4200 of the center wall 4110) that overlies the top rim 4200 and exterior surfaces 4111 and 4112 of the center inside wall 4110 of the filter 4010 and respective diametrically opposed and co-linear strip portions 4620A and 4622B that are defined on the top surface 4014 of the core 4012 and extend away from the center inside wall 4110 in the direction of the respective outside walls 4220 and 4018 of the duplex filter 4010.

Thus, and as further shown in FIG. 8, the elongated input/output connection areas of metallization or electrodes or strips of conductive material 4210A and 4210B are located at the opposite end of the filter 4010 in a co-linear and diametrically opposed relationship wherein the electrode 4210A extends from the outside wall 4220 in the direction of the center inside wall 4110 and the electrode 4210B extends from the opposed outside wall 4120 in the direction of the center inside wall 4110.

Further, and although not depicted or described herein in any detail, it is understood that the duplex filter 4010 is adapted to be mounted on the substrate or circuit board (PCB) 900 in a manner similar to the duplex filter 800 with the core top surface 4014 located opposite, parallel to, and spaced from the surface of the PCB 900 and the rim 4200 of the walls 4110, 4120, and 4220 seated on and soldered to the surface of the PCB 900, and thus the earlier description with respect to the mounting of the duplex filter 800 on the board 900 and the advantages associated therewith is incorporated herein by reference and applicable herein with respect to the mounting of the duplex filter 4010 on the board 900.

Numerous variations and modifications of the embodiments described above may be effected without departing from the spirit and scope of the novel features of the invention. It is to be understood that no limitations with respect to the specific filters illustrated herein are intended or should be inferred. It is, of course, intended to cover by the appended claims all such modifications as fall within the scope of the claims.

I claim:

1. A filter comprising:

a core with a top surface, a bottom surface, and side surfaces, said core defining a longitudinal axis, a first plurality of through-holes extending longitudinally along the top surface of the core, a second plurality of through-holes extending longitudinally along the top surface of the core in a spaced-apart and generally parallel relationship to the first plurality of through-holes, the first and second plurality of through-holes being spaced-apart from and located on opposite sides of the longitudinal axis of the core, each of the through-holes of the first and second plurality of through-holes extending through the core from an opening defined in said top surface of said core to an opening defined in said bottom surface of said core;

a center wall extending upwardly from the core in a relationship co-linear with the longitudinal axis of the core, the first and second plurality of through-holes being spaced-apart from and located on opposite sides of the center wall, the center wall defines a top rim adapted to be seated against a surface of a board; and a surface-layer pattern of metallized and unmetallized areas on said core, said pattern including first and second connection areas of metallization located on said top surface, and a third connection area of metallization located on said top surface and extending on said center wall.

2. The filter of claim 1, further comprising an interior layer of metallization extending through the core in a relationship co-linear with the center wall, the first and second plurality of through-holes being located on opposite sides of the layer of metallization.

3. The filter of claim 1, further comprising first and second outside walls extending upwardly from said top surface of said core, said center wall being located between and spaced from said first and second outside walls and said first and second connection areas of metallization extending on said first and second outside walls respectively.

4. The filter of claim 1, wherein the core is defined by first and second separate cores that have been coupled together in a side-by-side relationship and the center wall is defined by first walls on the first and second separate cores that have been coupled together in a side-by-side relationship.

5. The filter of claim 4, wherein each of said first and second separate cores includes a first side surface covered with a layer of metallization and the first side surfaces of the first and second separate cores are coupled together to define a layer of metallization that extends through the interior of the core of the filter between the first and second plurality of through-holes.

6. A filter comprising:

a block with a top surface, a bottom surface, and at least one side surface, the block defining a first plurality of through-holes extending between respective openings defined in the top and bottom surfaces, and a second plurality of through-holes extending between respective openings defined in the top and bottom surfaces of the block and in a relationship spaced-apart from and generally parallel to the first plurality of through-holes;

a plurality of walls extending outwardly from the top surface of the block including first and second outside walls and a third wall extending between the first and second outside walls;

a first pattern of metallized and unmetallized areas defined on the top surface of the block including an input connection area of metallization extending on the first wall and a first antenna connection area of metallization defined on the top surface and extending on the third wall; and a second pattern of metallized and unmetallized areas defined on the top surface of the block including an output connection area of metallization extending on the second wall and a second antenna connection area of metallization defined on the top surface and extending on the third wall and coupled to the first antenna connection area of metallization.

7. The filter of claim 6, wherein the block is defined by first and second blocks that have been coupled together, each of said first and second blocks including a first side surface covered with a layer of metallization and the first side surfaces of the first and second blocks are coupled together to define a layer of metallization that extends through the interior of the block of the filter between the first and second plurality of through-holes.

8. The filter of claim 6, wherein the third wall extends longitudinally along the center of the block between and in a relationship spaced from and parallel to the first and second outside walls.

9. The filter of claim 6, wherein the input and output connection areas of metallization are located at one end of the block and the first and second antenna connection areas of metallization are located at an opposite end of the block.

10. The filter of claim 9, wherein the input and output connection areas of metallization are disposed in a co-linear and diametrically opposed relationship and the first and second antenna electrodes are disposed in a co-linear and diametrically opposed relationship.

11. The filter of claim 6, wherein the block is comprised of first and second blocks that have been coupled together, the first and second patterns of metallized and unmetallized areas and the first and second outside walls being defined on the first and second blocks respectively.

12. The filter of claim 11, wherein the third wall extends in a relationship generally co-linear with the longitudinal axis of the block and is defined by respective walls on the first and second blocks that have been joined together.

13. A filter comprising:

a block with a top surface, a bottom surface, and at least one side surface, the block defining a first plurality of through-holes extending between respective openings defined in the top and bottom surfaces, and a second plurality of through-holes extending between respective openings defined in the top and bottom surfaces of the block and in a relationship spaced-apart from and generally parallel to the first plurality of through-holes;

a plurality of walls extending outwardly from the top surface of the block including at least a first wall, a second wall opposed to the first wall, and a third wall extending outwardly from the top surface of the block, the third wall being located between and separating the respective openings of the first and second plurality of through-holes defined on the top surface of the block;

a first pattern of metallized and unmetallized areas defined on the top surface of the block on one side of the third wall and including an input electrode defined on the top surface and extending on the first wall; and a second pattern of metallized and unmetallized areas defined on the top surface of the block on an opposite side of the third wall and including an output electrode defined on the top surface and extending on the second wall, and each of the first and second patterns of metallized and unmetallized areas including an antenna electrode defined on the top surface and both extending on the third wall.

14. The filter of claim 13, wherein the block is defined by first and second separate blocks coupled together in a side-by-side relationship.

15. The filter of claim 14, wherein each of the first and second separate blocks includes a first side surface with a layer of metallization, the first and second separate blocks being coupled together along said first side surfaces of said first and second separate blocks to define an interior layer of metallization in the block that separates the first and second plurality of through-holes.

* * * * *